United States Patent [19]

Yoshikawa et al.

[11] Patent Number: 4,977,067

[45] Date of Patent: Dec. 11, 1990

[54] METHOD OF AND APPARATUS FOR SUPPLYING REPLENISHERS TO AUTOMATIC PROCESSOR

[75] Inventors: Shoichi Yoshikawa; Yasunobu Awazu; Eiji Nishimura, all of Kyoto, Japan

[73] Assignee: Dainippon Screen Mfg. Co., Ltd., Kyoto, Japan

[21] Appl. No.: 390,857

[22] Filed: Aug. 8, 1989

[30] Foreign Application Priority Data

| | | | |
|---|---|---|---|
| Aug. 19, 1988 | [JP] | Japan | 63-206881 |
| Aug. 19, 1988 | [JP] | Japan | 63-206882 |
| Aug. 19, 1988 | [JP] | Japan | 63-206883 |
| Aug. 19, 1988 | [JP] | Japan | 63-206884 |

[51] Int. Cl.[5] ..... G03C 5/00

[52] U.S. Cl. ..... 430/398; 430/399; 430/450; 430/963

[58] Field of Search ..... 430/398, 399, 450, 963, 430/30; 210/739, 744, 96.1

[56] References Cited

U.S. PATENT DOCUMENTS

| | | | |
|---|---|---|---|
| Re. 30,123 | 10/1979 | Crowell | 137/624.15 |
| 3,822,723 | 7/1974 | Crowell | 137/624.15 |
| 3,970,457 | 7/1976 | Parsonage | 430/30 |
| 4,372,665 | 2/1983 | Kaufmann | 354/298 |
| 4,372,666 | 2/1983 | Kaufmann | 354/298 |

FOREIGN PATENT DOCUMENTS 62-91939 4/1987 Japan .

*Primary Examiner*—Peter Hruskoci
*Assistant Examiner*—Krisanne Shideler
*Attorney, Agent, or Firm*—Lowe, Price, Leblanc, Becker & Shur

[57] ABSTRACT

An automatic processor (1) has a developing tank (2) filled with a developer. In a memory (12), five programs for conducting various types of replenishments of the developer with chemicals (A, B and C) are previously stored. Mixing ratios of the chemicals are also stored in the memory. Area of photosensitive materials brought into the automatic processor are detected by a sensor (8), and in accordance with the area, the chemicals are delivered to the developing tank. By variably determining the mixing ratios according to the respective purposes of the replenishments, the replenishments can be attained under optimum conditions.

8 Claims, 14 Drawing Sheets

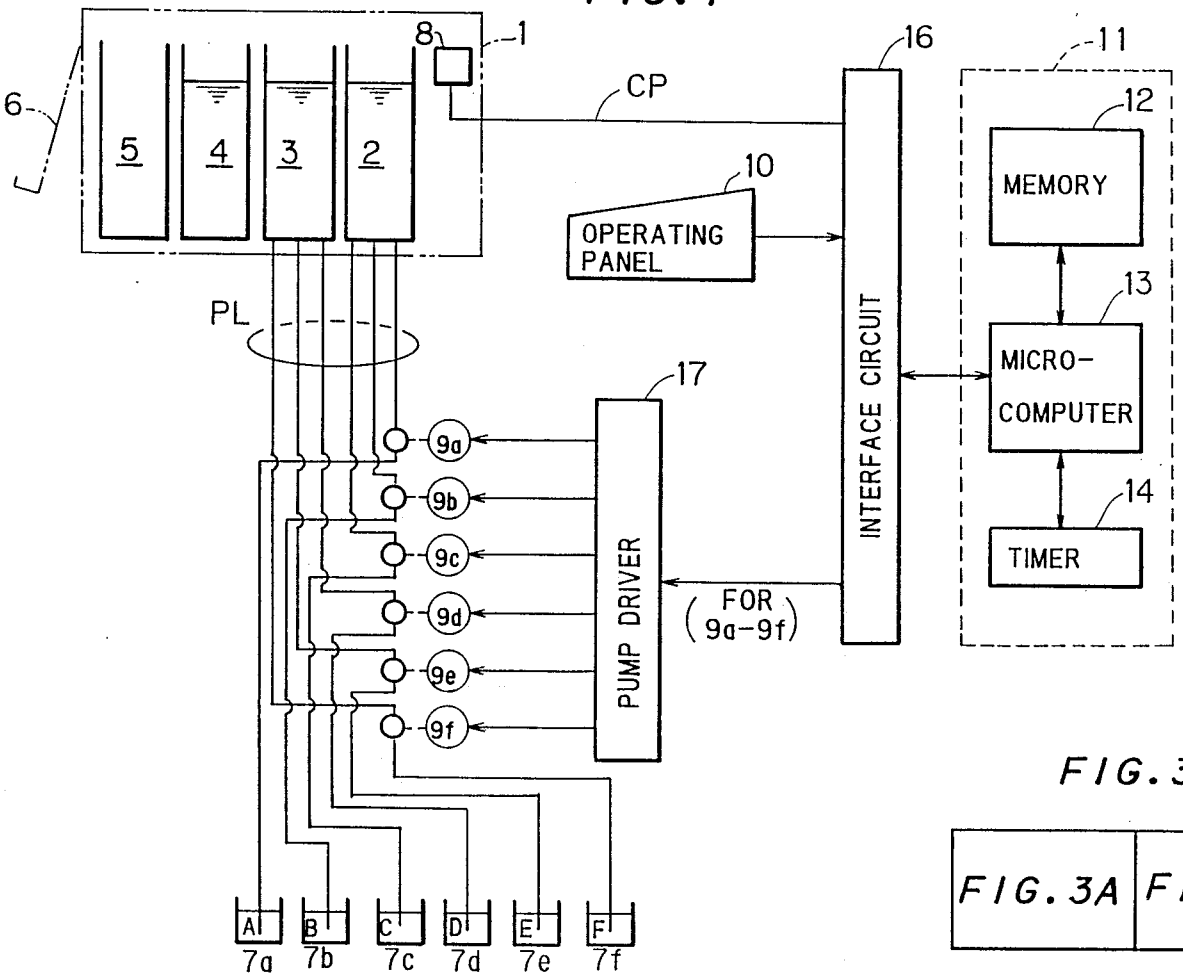
FIG. 1
11
12
MEMORY
13
MICRO-COMPUTER
14
TIMER
16
INTERFACE CIRCUIT
10
OPERATING PANEL
CP
FOR (9a-9f)
17
PUMP DRIVER
1
8
2
3
4
5
6
PL
9a
9b
9c
9d
9e
9f
A
B
C
D
E
F
7a
7b
7c
7d
7e
7f
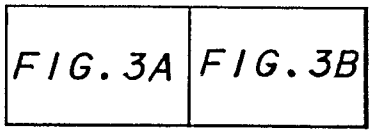
FIG. 3
FIG. 3A
FIG. 3B

METHOD OF AND APPARATUS FOR SUPPLYING REPLENISHERS TO AUTOMATIC PROCESSOR

BACKGROUND OF THE INVENTION

1. Field of the Invention

The present invention relates to a method of and an apparatus for supplying replenishers to automatic processors or automatic developing machines, and more particularly to delivery control of the replenishers in high-contrast processors which are used in photographic process for printing.

2. Description of Prior Arts

Recently, developer capable of high-speed development at high temperature which is called as "Rapid Access or RAS Development" has been brought into the field of high-contrast development using automatic processors. The merits of the RAS development has been appreciated, and it is often used in automatic processors.

In the RAS development, a replenisher is obtained by mixing chemicals at predetermined mixing ratios, where one of the chemicals may be a diluent. The replenisher will be deteriorated or oxidized by the air within some days after the mixture of the chemicals. Therefore, often employed is an instant mixing method in which only required amounts of chemicals are mixed on each request of replenishment, rather than a previous mixing method in which large amounts of chemicals are previously mixed and the replenisher thus obtained is stocked to be used part by part. According to the instant mixing method, previous mixing of chemicals with large tanks is not required and the instant mixing of chemicals can be carried out with small tanks for chemicals and a water pipe when the diluent is water. Consequently, the instant mixing method has become a main stream in replenishment of developer.

The mixing ratios of chemicals are not universal but depend on the kinds of the chemicals which are commercially obtainable from the manufacturers thereof. Furthermore, an amount of the replenisher which is to be supplied to the automatic processor on each request of replenishment (hereinafter called "a unit amount in replenishment") depends on the purpose of the replenishment, e.g., that for compensating aged-deterioration (anti-oxidation), used-deterioration (exhaustion) and others.

A conventional apparatus for replenishing developer is constructed so as to select the mixing ratio of chemicals within prescribed two ratios, i.e., that for high-activity replenisher and low-activity replenisher, and therefore, complex control of replenishment cannot be attained by the conventional apparatus.

Another problem in the conventional apparatus is that a predetermined unit amount of the replenisher is always supplied to the automatic processor regardless of timing relation between successive replenishments, and as a result, the chemical activity of developer in the automatic processor is sometimes undesirably increased.

SUMMARY OF THE INVENTION

The present invention is directed to an apparatus for replenishing a treatment liquid in an automatic processor with a replenisher which is obtained by mixing a plurality of chemicals. The treatment liquid is previously supplied to a treatment tank in which exposed photosensitive materials are treated by the treatment liquid for development of the photosensitive materials.

According to the present invention, the apparatus comprises: (a) respective delivery means for delivering the plurality of the chemicals to the treatment tank, said delivery means comprising pumping means, (b) means coupled to the respective delivery means, for activating the respective delivery means for designated activation time spans every time request for replenishment of the treatment liquid is received, (c) means for finding whether or not first deliveries of the plurality of chemicals responsive to a first request of replenishment are over, and (d) means coupled to the means (c) for postponing second deliveries of the plurality of chemicals responsive to a second request of replenishment until the first deliveries are over, if the second request of replenishment is received before the first deliveries are over.

Preferably, the means (c) includes (c-1) counter means for starting to count clock time when the first deliveries are started and for counting the clock time until all of the activation time spans are over, and (c-2) means for referring to the clock time counted by the counter means when the second request of replenishment is received, to find whether or not all of the activation time spans are expired.

In an aspect of the present invention, the apparatus comprises: (a) first memory means for storing information representing a plurality of replenishment rules for replenishing treatment liquid with respective replenishers, (b) input means for variably inputting a mixing ratio of chemicals for each replenisher to set a plurality of mixing ratios, (c) second memory means for storing the plurality of mixing ratios, (d) means for monitoring an operating state of the automatic processor, (e) means for reading-out the information to compare the operating state with respective conditions for replenishment defined in the plurality of replenishment rules, (f) means for generating a replenishment command when the operating state matches one of the respective conditions, (g) means for selecting one of the plurality of mixing ratios corresponding to the one of the respective conditions, (h) means for determining respective amounts of the plurality of chemicals in accordance with the one of the plurality of mixing ratios, and (i) respective delivery means comprising pumping means for delivering the amounts of the plurality of chemicals to the treatment tank in response to the replenishment command, the plurality of chemicals being mixed in the treatment tank to become a replenisher.

The present invention is also directed to a method of replenishing a treatment liquid in an automatic processor with replenishers.

According to the present invention, the method comprises the steps of: (a) determining a first time period, (b) dividing the first time period into two or more time periods to thereby define a series of second time periods, (c) delivering a first replenisher to the treatment tank according to a predetermined replenishment rule in order to replenish the treatment liquid with the first replenisher, (d) counting developed area of photosensitive materials which are treated by the treatment liquid in the treatment tank within each second time period, (e) comparing the developed area with a predetermined threshold area, (f) reducing an amount of the first replenisher which is delivered to the treatment tank within a next second time period following to a second time period in which the developed area exceeds the threshold area, (g) counting a total amount of the first replenisher which is delivered to the treatment tank within the first time period, (h) calculating a difference between a predetermined threshold amount and the total amount, and (i) delivering a second replenisher to the treatment tank when the first time period is expired in order to replenish the treatment liquid with the second replenisher, wherein an amount of the second replenisher delivered to the treatment tank is determined in accordance with the difference.

In a preferred embodiment, the method comprises the steps of: (a) delivering a plurality of first replenishers to the treatment tank at different timings in order to replenish the treatment liquid with the plurality of first replenishers, respectively, wherein respective mixing ratios of the plurality of chemicals for producing the plurality of first replenishers are previously determined, (b) counting respective total amounts of the plurality of chemicals which are used for replenishment of the treatment liquid in the step (a) within a predetermined time period, and (c) delivering a second replenisher to the treatment tank in order to replenish the treatment liquid with the second liquid after the time period is expired, wherein the second replenisher is a mixture of the plurality of chemicals at a mixing ratio proportional to a ratio of the total amounts.

Accordingly, an object of the present invention is provide a method of and an apparatus for replenishing a treatment liquid with replenishers in which various types of replenishments are selectively attained.

Another object is to conduct an optimum control of replenishment for maintaining required chemical conditions of a treatment liquid in automatic processors.

Another object is to vary supplied amounts of replenishers according to a history of previous replenishments.

Further another object is to provide flexible control of replenishments.

These and other objects, features, aspects and advantages of the present invention will become more apparent from the following detailed description of the present invention when taken in conjunction with the accompanying drawings.

BRIEF DESCRIPTION OF DRAWINGS

FIG. 1 is a schematic diagram showing an apparatus for replenishing a developer and a fixer with replenishers according to a preferred embodiment of the present invention, FIG. 3 shows how the sheets containing

DESCRIPTION OF PREFERRED EMBODIMENTS

A. Overall Structure

Figure 2:
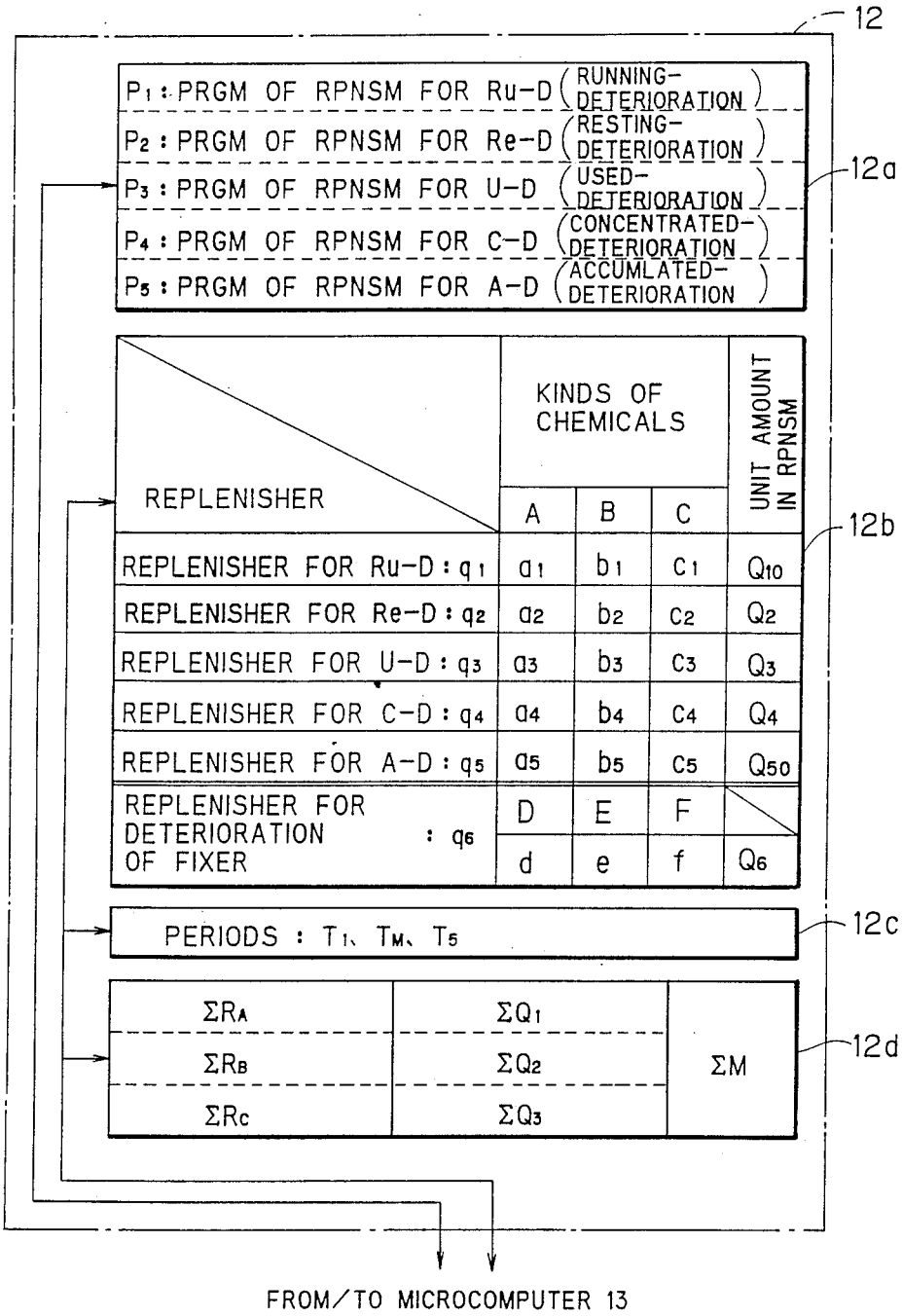
FIG. 2 shows contents of data which are stored in a memory 12.

Referring to FIG. 1, there is illustrated in block diagram form, by way of example, an apparatus in accordance with a preferred embodiment of the present invention. An automatic processor or an automatic developing machine 1 comprises a developing tank 2 and a fixing tank 3 to which developer and fixer are previously supplied, respectively. The developer is obtained by mixing three types of chemicals A, B and C, while the fixer is obtained by mixture of other three chemicals D–F.

The chemicals A–C and D–F are also used for producing replenishers for the developer and the fixer, respectively. The chemicals A, B, D and E can be commercially obtainable from manufacturers thereof as a developer/fixer system. The following Table 1 show the names of developer/fixer systems and the manufacturers thereof, and Table 2 show respective contents of the chemicals A–F in the developer/fixer systems, in which respective product names or symbols are indicated. Since the chemicals C and F are water as diluent, these chemicals C and F can be obtained from a water pipe.

TABLE 1

| No. | Name of System | Manufactures |
|---|---|---|
| 1 | ULTRATEC (Trade Mark) | EASTMAN KODAK COMPANY: Rochester, N.Y. U.S.A. |
| 2 | RST SYSTEM | KONICA CORPORATION: TOKYO, JAPAN |
| 3 | AGFASTER | AGFA-GEVAERT N.V.: MORTSEL, Belguim |
| 4 | — | E. I. Dupont de Nemours and Company: Wilmington, Delaware U.S.A. |
| 5 | GRANDEX SYSTEM | FUJI PHOTO FILM CO., LTD.: TOKYO, JAPAN |

TABLE 2

| No. | A | B | C | D | E | F |
|---|---|---|---|---|---|---|
| 1 | ULTRA DEVELOPER AND REPLENISHER | — | Water (Diluent) | ULTRA FIXER AND REPLENISHER | — | Water (Diluent) |
| 2 | CDM-651KA | CDM-651KB | Water (Diluent) | CFL-851A | DFL-851B | Water (Diluent) |
| 3 | G700A | G700B | — | G333CA | G333CB | Water (Diluent) |
| 4 | CUFDA | CUFDB | Water (Diluent) | DLEFA | DLEFB | Water (Diluent) |
| 5 | GD-D1 | — | Water (Diluent) | GD-F1 | — | Water (Diluent) |

NOTE:
The numbers 1 through 5 indicate the developer/fixer systems with same numbers in Table 1.

In order to supply the chemicals A–C and D–F to the tanks 2 and 3, respectively, a pipe line network PL is provided between the treatment tanks 2, 3 and chemical tanks *7a–7f* in which the chemicals A–F are stored. Metering pumps *9a–9f* are provided in respective pipe lines to deliver the chemicals A–C and D–F from the chemical tanks *7a–7c* and *7d–7f* to the treatment tanks 2 and 3, respectively. The pumps *9a–9f* are bellows pumps operable to deliver respective constant amounts $V_a$–$V_f$ of the chemicals A–F per unit time, for example. Respective values of $V_a$–$V_f$ may be different from each other, or alternatively, may be equal to each other.

A photosensitive film (not shown) on which a latent image has been formed is brought into the automatic processor 1, and is dipped into the developer in the developing tank 2.

After the development, the photosensitive film is dipped into the fixer in the fixing tank 3 in order to fix the developed image.

The photosensitive film is then transferred to a water tank 4 to be rinsed, and is dried in a drier space 5. The dried photosensitive film is delivered to a tray 6 to be placed thereon. The conveyance of the photosensitive film along the treatment path is automatically carried out with a conveyance mechanism provided in the automatic processor 1. These treatments are repeated for a number of photosensitive films which are brought into the automatic processor 1.

The automatic processor 1 is also provided with an area sensor 8. The area sensor 8 has a film detector for detecting the width and the length of photosensitive films. An electronic microprocessor provided in the area sensor 8 calculates the sum of the treated areas of the photosensitive films on the basis of the detected width and length to generate a count pulse CP every time the sum of the treated areas of the photosensitive films increases by a predetermined unit area, e.g., 480 inch$^2$.

A controller 11 for controlling deliveries of the chemicals A–F comprises a memory 12, a microcomputer 13 and a timer 14. As will be more fully described later, a plurality of control programs and various control data are stored in the memory 12. The control data is previously and variably inputted with an operating panel 10 and/or a magnetic storage medium. The microcomputer 13 reads-out the control programs and the numerical data from the memory 12 to conduct a control sequence according to the control programs with reference to the control data and area information obtained from the count pulse CP. When replenishment of developer or fixer is required, the microcomputer 13 gives driving signals to a pump driver 17 through an interface circuit 16 and the pump driver 17 drives the pumps *9a–9c* or *9d–9f*.

B. Control Programs and Control Data

Details of the control programs and the control data which are stored in the memory 12 are schematically shown in FIG. 2. The memory 12 has four storage regions *12a–12d*, details of which are as follows:

(a) First Storage Region *12a*

Figure 3A:
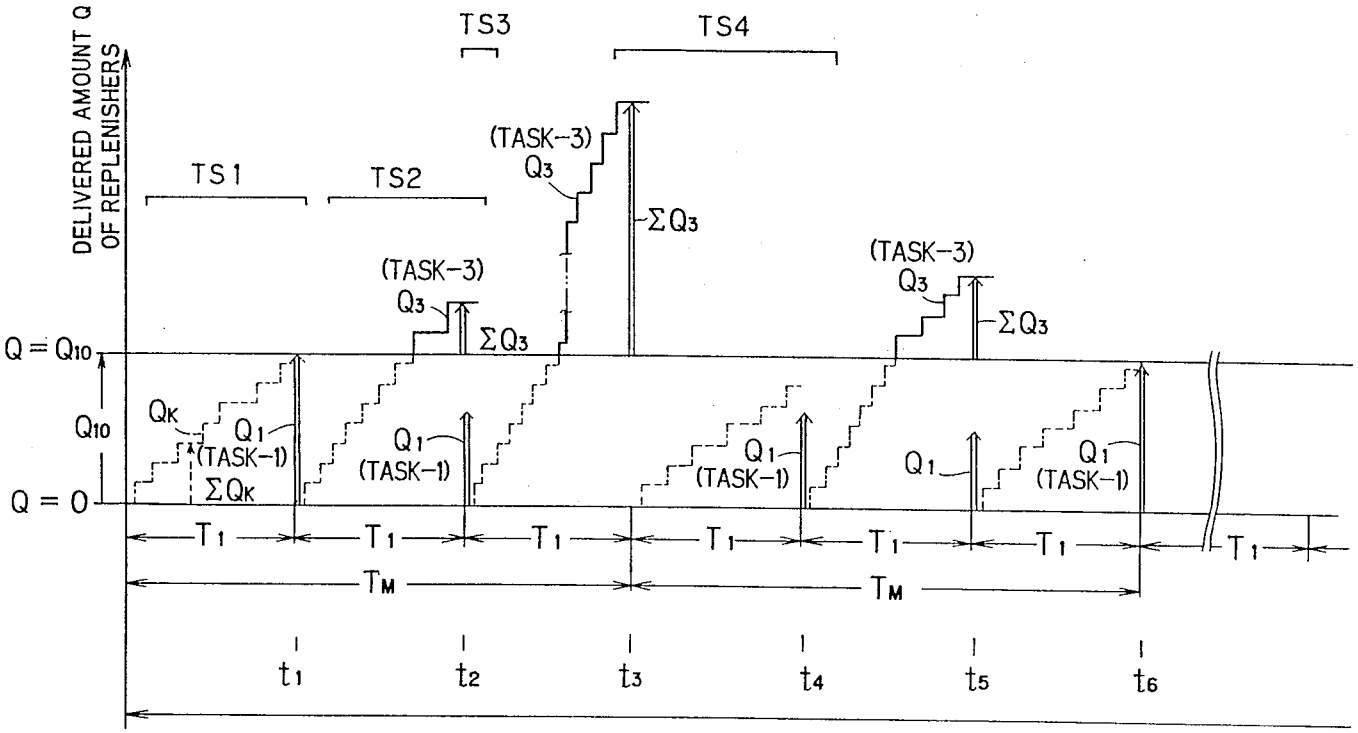
FIG. 3A and FIG. 3B are to be arranged, FIG. 3A and FIG. 3B as arranged according to FIG. 3 show a timing chart whose horizontal axis indicates time and vertical axis indicates amounts of replenishers delivered to a developer tank in an automatic processor.
Figure 3B:
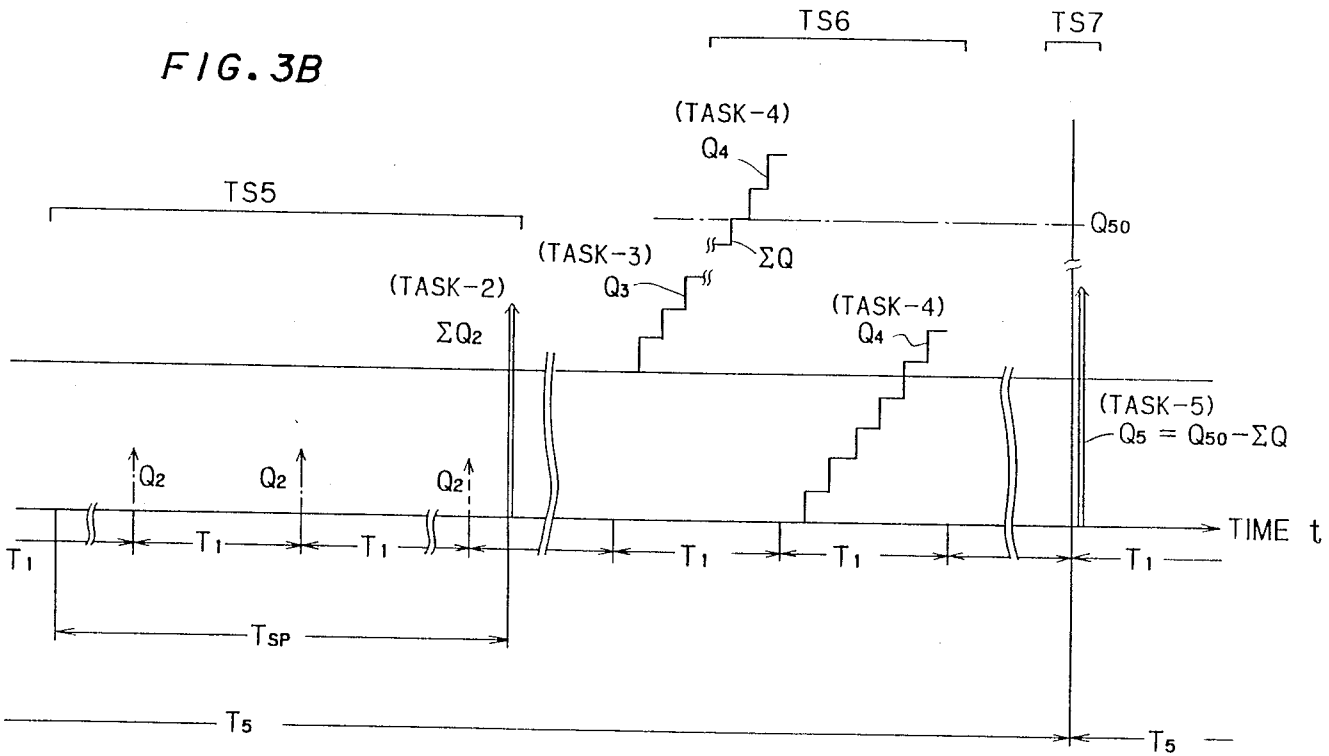

In the storage region *12a*, five programs $P_1$–$P_5$ for replenishment of developer and another program (not shown) for replenishment of fixer are previously stored. In order to understand the respective outlines of the programs $P_1$–$P_5$, also referred to is FIG. 3A and FIG. 3B as combined with each other in accordance with the configuration shown in FIG. 3. In FIG. 3A and FIG. 3B, the horizontal axis is a time axis and the vertical axis indicates amounts of delivered replenishers. Respective contents of replenishers $q_1$–$q_6$ appearing in the following description will be specified later.

Program $P_1$

The first program $P_1$ is intended for compensating aged-deterioration or oxidation of the developer which is caused in running time of the automatic processor 1. This type of deterioration is called "running-deterioration" or "Ru-D" in the present specification and drawings. For compensating running-deterioration, an amount $Q_1$ of a replenisher $q_1$ (see FIG. 3A) is supplied to the treatment tank 2 every time period $T_1$. The amount $Q_1$ is not constant but variable depending on an accumulated amount $\Sigma Q_3$ which will be defined later. That is, when the accumulated amount $\Sigma Q_3$ of a replenisher $q_3$ which was supplied to the developing tank 2 during a time period $T_1$ is less than a predetermined unit amount $Q_{10}$ as shown in a time section TS3 in FIG. 3A, an amount $Q_1 = Q_{10} - \Sigma Q_3$ of the replenisher $q_1$ is added to the tank 2. On the other hand, when the accumulated amount $\Sigma Q_3$ is more than the unit amount $Q_{10}$ as shown in a time section TS4, the amount $Q_1$ is once reduced to zero and the amount $Q_1$ in the next replenishment is also reduced until the total of the reductions compensates the excess $\Sigma Q_3 - Q_{10}$. The replenishment with the program $P_1$ is one of anti-oxide replenishments. The other anti-oxidation replenishment is conducted by the program $P_2$ which is hereinafter described.

Program $P_2$

The program $P_2$ is provided for compensating aged-deterioration or oxidation of the developer during the operation of the automatic processor 1 is stopped, e.g., rest of operation over night and holidays. As shown in a timing section TS5 of FIG. 3B, a time $T_{SP}$ of operation stop is measured with the timer 14, and a predetermined unit value $Q_2$ is multiplied by a number proportional to the resting time $T_{SP}$ to obtain an accumulated value $\Sigma Q_2$.

Then, an amount of a replenisher $q_2$ corresponding to the accumulated value $\Sigma Q_2$ is supplied to the developing tank 2, to thereby compensate the deterioration. This type of deterioration is called "resting-deterioration" or "R-D".

Program $P_3$

The program $P_3$ is prepared for compensating used-deterioration (U-D) of the developer. In order to be determine an amount of a replenisher $q_3$ which is to be supplied for compensating the used-deterioration, a value $Q_k$ is previously determined and the value $Q_k$ is accumulated every time a unit area of photosensitive films is treated by the automatic processor 1. The accumulation is depicted by dotted steps in FIG. 3A, and the accumulation is reset every time the time period $T_1$ is expired. The accumulated value $\Sigma Q_k$ is compared with the unit amount $Q_{10}$. The replenisher $q_3$ for compensating the used-deterioration is not supplied to the developer tank 2 so long as the value $\Sigma Q_k$ is less than the unit amount $Q_{10}$ (see a time section TS1 in FIG. 3A). On the other hand, when the accumulated value $\Sigma Q_k$ exceeds the unit amount $Q_{10}$ (see a time section TS2, for example), it is started to supply a predetermined unit amount $Q_3$ of the replenisher $q_3$ to the tank 2 every time an unit area of photosensitive films is treated by the automatic processor 1 as shown in FIG. 3A by solid steps. The total or accumulated amount $\Sigma Q_3$ which is supplied to the tank 2 during the time period $T_1$ is calculated, and the value representing the accumulated amount $\Sigma Q_3$ is used for determining the amount $Q_1$, as is hereinabove described.

In other words, the accumulated value $\Sigma Q_k$ represents an imaginary amount in the sense that the same is calculated to inhibit the replenishment while the condition $\Sigma Q_k < Q_{10}$ is satisfied and the value $Q_{10}$ is a threshold value for inhibition. The reason why the inhibition is introduced to the replenishment control is that the program $P_3$ is directed to compensate the deterioration which is not compensated by the replenishment with the program $P_1$.

Program $P_4$

The program $P_4$ is directed to replenishment of the developer for compensating deterioration due to concentration of photosensitive films ("concentrated-deterioration" or "C-D"). That is, when many photosensitive films are brought into the automatic processor 1 for development thereof and the total amount $\Sigma Q = \Sigma Q_1 + \Sigma Q_2 + \Sigma Q_3$ which was supplied to the tank 2 in a predetermined time period $T_5$ exceeds a predetermined amount $Q_{50}$, a predetermined unit amount $Q_4$ of a replenisher $q_4$ is supplied to the tank 2 every time an unit area of photosensitive films is treated or developed after the total amount $\Sigma Q$ reaches the value $Q_{50}$ (see a time section TS6 in FIG. 3B). The time period $T_5$ is relatively long time as compared with the time period $T_1$, where $T_5$ may be 24 hours or 40 hours, for example, while $T_1$ may be 30 minutes.

Program $P_5$

According to the program $P_5$, the total amount $\Sigma Q$ of replenishment is compared with the unit amount $Q_{50}$ every time the unit period $T_5$ is expired, and if $\Sigma Q < Q_{50}$, the amount $Q_{50} - Q$ of a replenisher $q_5$ is supplied. The replenishment compensates deterioration of the developer having been accumulated in the time period $T_5$. This type of deterioration is called as "accumulated deterioration" or "A-D" in the present specification and drawings.

The other program for replenishment of fixer may be prepared such that a predetermined amount of a replenisher $q_6$ for the fixer is supplied to the fixing tank 3 every time a predetermined unit area of photosensitive films are dipped to the developer and the fixer. To both of the replenishments of the developer and the fixer, the instant mixing method is applied. That is, only amounts of chemicals A–C or D–F which are required for current replenishment are delivered to the tank 2 or 3 through the pumps *9a–9c* or *9d–9f* and the pipe line network PL.

(b) Second Storage Region *12b*

Referring to FIG. 2, stored in the second storage region *12b* are respective mixing ratios of the chemicals A–C (D–F) and respective values representing the unit amounts for the replenishers $q_1$–$q_6$. For example, the values representing a ratio $A:B:C = a_1:b_1:c_1$ and the unit amount $Q_{10}$ are stored for the replenisher $q_1$.

The mixing ratios and the unit amounts depend on the type of the developer/fixer system, since contents of the chemical A–F may be different for each type of the developer/fixer systems. Table 3 shows examples of these ratios and unit amounts for four types I–IV of developer/fixer systems. Since the replenishment with the replenisher $q_1$ and $q_2$ are not required in the type(s) I and II-III, respectively, the symbol "-" is provided in the corresponding parts. The values shown in Table 3 are examples for the case where the automatic processor 1 is "an automatic photosensitive film processor No. LD-281-Q" which is obtainable from Dainippon Screen Mfg., Kyoto, Japan. If the type IV of the developer/fixer system is employed, for example, the numerical data indicated in the row of IV are stored in the storage region *12b*. When the developer/fixer system is replaced to another system, the numerical data are changed according to Table 3.

TABLE 3

| | Replenishers | | | | | |
|---|---|---|---|---|---|---|
| | $q_1$ | $q_2$ | $q_3$ | $q_4$ | | $q_5$ |
| I | | | | | | |
| Chemicals & Mixing Ratios | | | | | | |
| A | — | 0 | 10 | 10 | D | 10.5 |
| B | — | 0 | 1.5 | 1.5 | E | 1 |
| C | — | 0.1 | 18.5 | 18.5 | F | 28.5 |
| Unit Amount in Replenishment | — | * 156 | ** 120 | ** 120 | | ** 160 |
| II | | | | | | |
| Chemicals & Mixing Ratios | | | | | | |
| A | 5 | — | 5 | 5 | D | 1 |
| B | 0 | — | 0 | 0 | E | 0 |
| C | 1 | — | 1 | 1 | F | 3 |
| Unit Amount in Replenishment | * 337 | — | ** 168 | ** 168 | | ** 168 |
| III | | | | | | |
| Chemicals & Mixing Ratios | | | | | | |
| A | 20 | — | 20 | 20 | D | 10 |
| B | 1 | — | 1 | 1 | E | 1 |
| C | 0 | — | 0 | 0 | F | 40 |
| Unit Amount in Replenishment | * 238 | — | ** 84 | ** 84 | | ** 80 |
| IV | | | | | | |
| Chemicals & | | | | | | |

TABLE 3-continued

| | Replenishers | | | | | |
|---|---|---|---|---|---|---|
| | $q_1$ | $q_2$ | $q_3$ | $q_4$ | | $q_5$ |
| Mixing Ratios | | | | | | |
| A | 4 | 4 | 4 | 2 | D | 1 |
| B | 0 | 0 | 0 | 0 | E | 0 |
| C | 3 | 3 | 3 | 1 | F | 2 |
| Unit Amount & | * | * | ** | ** | | ** |
| Replenishment | 139 | 83 | 75 | 75 | | 120 |

*m/30 min.
**m/480 inch$^2$
C = 0.1 in the row I, column $q_2$ is a coefficient of replenishment.

Among the values $a_i$, $b_i$, $c_i$ (i=1−5), d, e and f representing the mixing ratios, the values $a_i$, $b_i$, $c_i$ (i=1−4), d, e and f are previously determined according to the corresponding row of Table 3, while the values $a_5$, $b_5$ and $c_5$ are calculated every time period $T_5$ after the automatic processor 1 is enabled, details of which will be described later. Although the mixing ratios for respective replenishers are identical to each other or partially different from each other in each row I–IV in Table 3, the mixing ratios may be fully different from each other among the respective replenishers.

(c) Third Storage Region 12*c*

The storage region 12*c* in FIG. 2 is prepared so as to store the numerical data representing the time periods $T_1$, $T_M$ and $T_5$. The time period $T_M$ is set at a value larger than $T_1$ but smaller than $T_5$, and is three times the time period $T_1$ in the preferred embodiments (see FIG. 3A). The reason why the intermediate time period $T_M$ is introduced into the replenishment control will be described later. The time period $T_M$ is called as "a sampling period".

The values of the time periods $T_1$, $T_M$ and $T_5$ as well as the mixing ratios (other than $a_5$, $b_5$ and $c_5$) and the unit amounts are inputted by push keys provided in the operating panel 10 (FIG. 1) or through a magnetic storage midum.

(d) Fourth Storage Region 12*d*

The fourth storage region 12*d* store accumulating values $\Sigma R_A$, $\Sigma R_B$ and $\Sigma R_C$ which are respective summation of amounts $R_A$, $R_B$ and $R_C$ of the chemicals A, B and C having been supplied to the tank 2 in the time period $T_5$, respectively. Values representing the accumulated amounts $\Sigma Q_1$, $\Sigma Q_2$ and $\Sigma Q_3$ of the replenishers $q_1$, $q_2$ and $q_3$ which were supplied to the tank 2 are also stored in the storage region 12*d*. These values are used for calculating the value $\Sigma Q$ and determining the values $a_5$, $b_5$ and $c_5$.

Furthermore, an accumulated value $\Sigma M$ representing a total area of photosensitive films having been developed in the automatic processor 1 in the sampling period $T_M$ is stored in the storage region 12*d*.

Other than the data shown in FIG. 2, various data may be previously or temporarily stored in the memory 12.

B. Overall Operation

Figure 4:
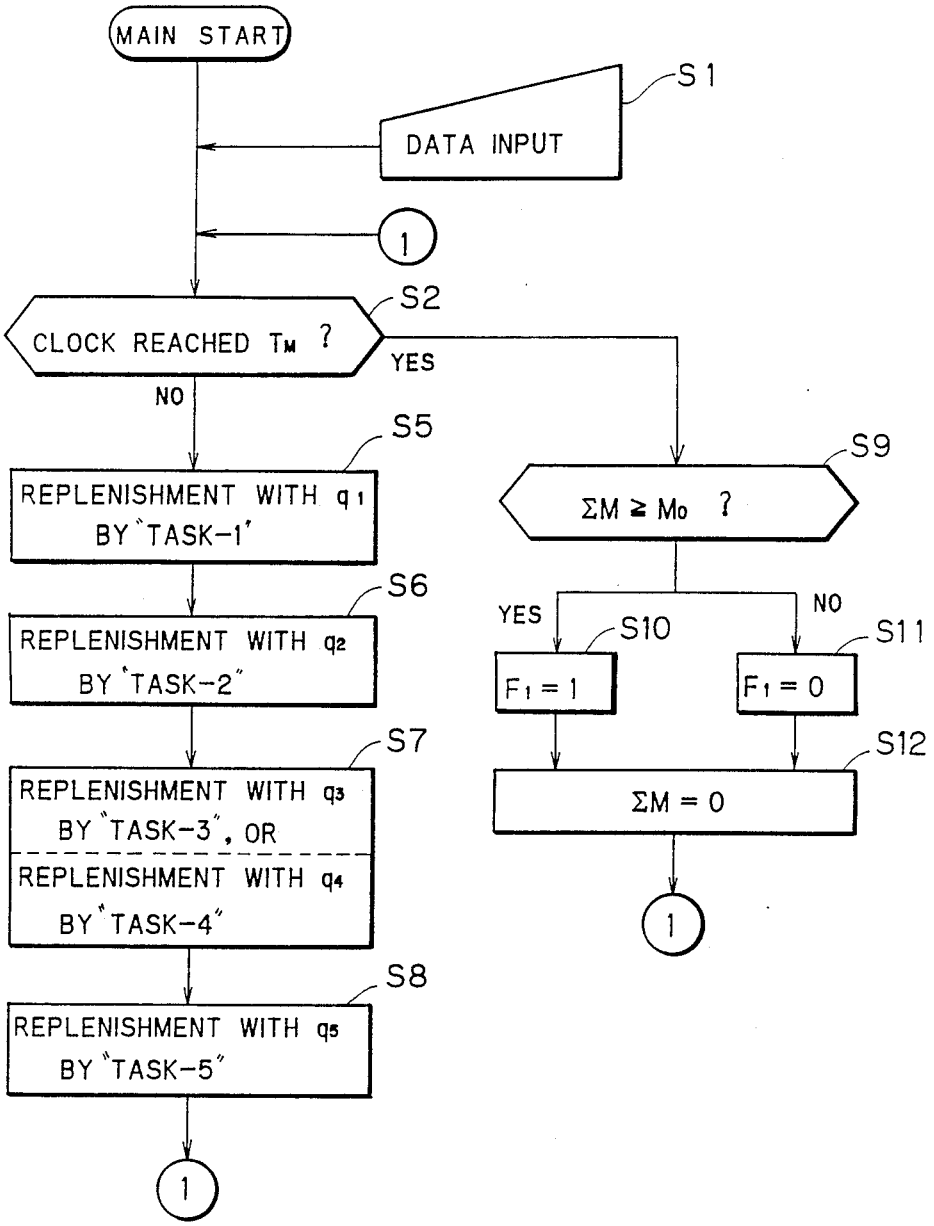
FIG. 4 is a flowchart showing a main task which is conducted by a microcomputer in order to replenish the developer.
Figure 5:
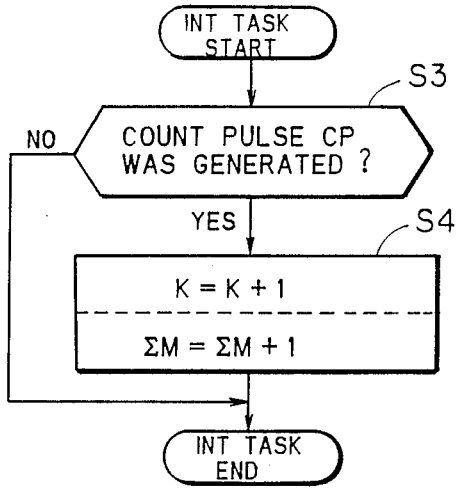
FIG. 5 is a flowchart showing an interruption task directed to respective increments of count values K.

The present section is directed to the overall operation for replenishing the developer with the replenishers $q_1$–$q_5$, which is depicted in FIG. 4 and FIG. 5. Details thereof are described in the following sections. Although the replenishment of the fixer will not be described in detail, it can be attained by adding the unit amount $Q_6$ of the replenisher $q_6$ to the tank 3 every time a unit area of photosensitive films is treated, where the replenisher $q_6$ is obtained by mixing the chemicals D, E and F at the constant ratio d:e:f.

Referring to FIG. 4, various data required for automatic replenishment of the developer and the fixer are variably inputted in the process step S1 from the operation panel 10 and/or the magnetic storage medium such as magnetic cards, which data includes $a_i$, $b_i$ and $c_i$ (i=1−4), c, d and f $Q_i$(i=10,2−4,6,50) and the values representing the time periods $T_1$, $T_M$ and $T_5$. The inputted data is stored in the storage regions 12*b* and 12*c* in the memory 12 in the form depicted in FIG. 2. The programs $P_1$–$P_5$ are previously prepared and stored in the storage region 12*a*. The routine which is executed repeatedly after storing the inputted data is as follows:

In the next process step S2, it is judged whether the clock reaches the end of the sampling period $T_M$ or not. In order to generate clock signals and other time-count signals, the timer 14 (FIG. 1) comprises a clock generator. A power required for the operation of the timer 14 may be supplied from a battery provided in the apparatus whereby the time-count operation is attained even if the main power is stopped.

If it is found that the clock time has not reached the end of one sampling period $T_M$, the process proceeds to the process step S5. In parallel with the main task shown in FIG. 4, an interruption task shown in FIG. 5 is conducted. That is, it is judged in the process step S3 whether or not the count pulse CP was generated in the area sensor 8, and if generated, a count value K for counting the number of the count pluses CP is incremented by one. Furthermore, the accumulated value $\Sigma M$ representing a total area of photosensitive films which were developed in the current sampling period $T_M$ is also incremented by one (the process step S4). The accumulated value $\Sigma M$ is reset to zero at respective start points of the sampling periods $T_M$, whereby the value $\Sigma M$ increases as 1, 2, 3 . . . in each sampling period regardless of its value in the preceeding sampling periods.

The values K will be referred to in the "TASK-3" and "TASK-4" (FIG. 11 and FIG. 12) for determining whether or not the replenishers $q_3$ and $q_4$ should be supplied, respectively, while the accumulated value $\Sigma M$ will be referred to in the process step S9 (FIG. 4).

Now back to the main task in FIG. 4, the replenishments with the replenishers $q_1$–$q_5$ are conducted in he process steps S5–S8. The "TASK-1" through "TASK-5" indicated in these process steps S5–S8 are directed to these replenishments and details thereof will be described later. The "TASK-1" through "TASK-5" correspond to the programs $P_1$–$P_5$, respectively. As will be understood later, the "TASK-1" through "TASK-5" include judgments whether the corresponding replenishment should be immediately performed, postponed or omitted. It is to be noted that the "TASK-3" and the "TASK 4" are selectively performed in the process step S7.

Incidentally, when the power supply to the automatic processor 1 is interrupted due to outage or the like, amounts of the replenishers $q_1$–$q_5$ which were intended to be supplied but were not supplied due to the power interruption are calculated by a subroutine (not shown) and the value representing the calculated amounts is stored in a RAM which is provided in the controller 11. The value is read-out from the RAM when the power supply is resumed, and the calculated amounts of the replenishers are supplied to the tank 2 just after the resumption of the power supply. The subroutine is performed for all of the replenishments with the replenishers $q_1$–$q_5$.

On the other hand, when the current sampling period $T_M$ (FIG. 3) is expired, the process exceeds from the step S2 to the step S9 to thereby judge whether or not the total area $\Sigma M$ of photosensitive films which has been treated in the sampling period $T_M$ exceeds the predetermined value $M_0$. If $\Sigma M \geqq M_0$, a flag $F_1$ is set at "1" in the process step S10. If $\Sigma M < M_0$, on the other hand, the flag $F_1$ is set at "0" in the process step S11. The flag $F_1$ is "a reduction flag" designating reduction of replenishment in the next sampling period $T_M$. The value $\Sigma M$ indicating the treated area is reset to "0" in the next process step S12 for the next sampling period $T_M$.

If the time period $T_5$ is 24 hours and the sampling period $T_M$ is 5 hours, the last sampling period $T_M$ in the time period $T_5$ becomes 4 hours. Such non-uniformity causes no problem and the accumulation of the treated area $\Sigma M$ may be omitted in the last time period $T_M=4$ hours, since the value $\Sigma M$ will be reset at the end of the time period $T_5$.

Compensation of Running-Deterioration

Figure 6:
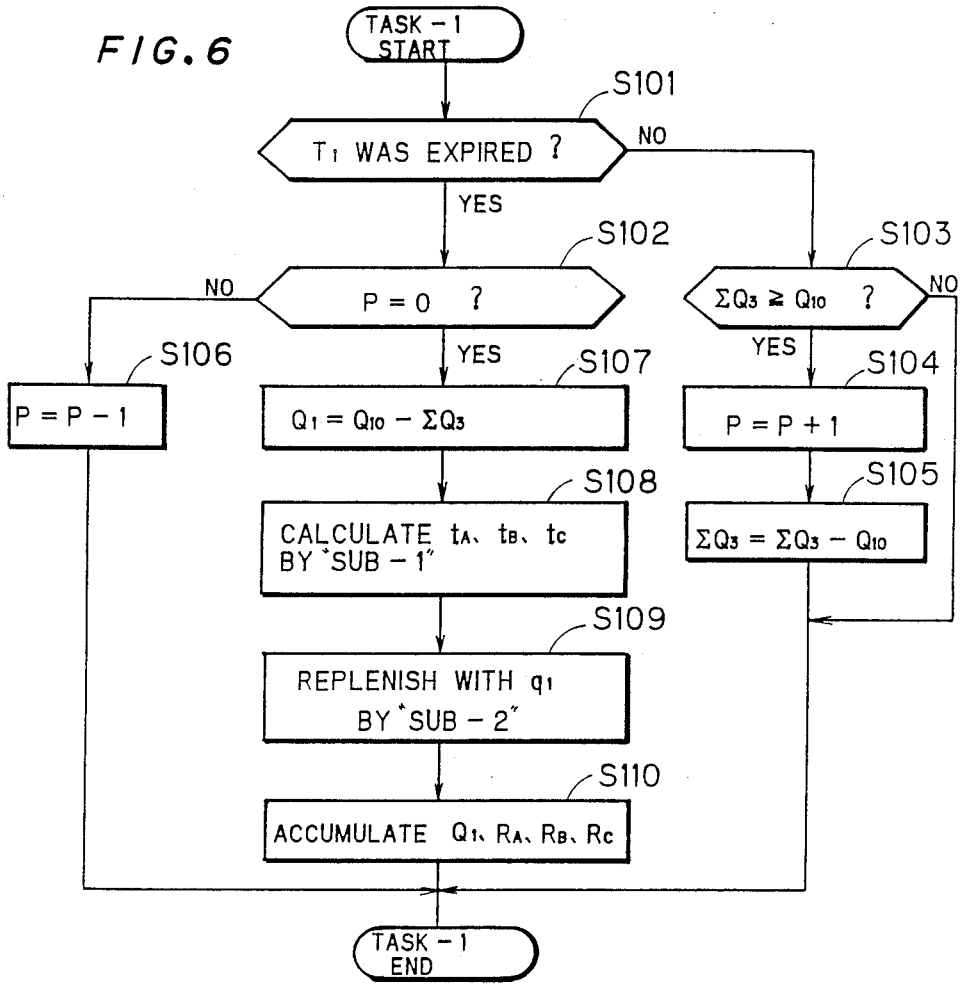
FIG. 6 is a flowchart showing "TASK-1" which corresponds to a program $P_1$ of replenishment for compensating a running-deterioration.

The compensation of running-deterioration with the replenisher $q_1$ is attained by the program $P_1$, whose contents are shown in FIG. 6 as the "TASK-1".

In the first process step S101 of the TASK-1, it is judged with reference to the timer 14 whether a time period $T_1$ was expired or not, and if not expired, the process proceeds to the process step S103. In the process step S103, the accumulated amount $\Sigma Q_3$, which is calculated in the process step S303 in FIG. 11 as hereinafter described, is compared with the unit amount $Q_{10}$.

When the accumulated amount $\Sigma Q_3$ is equal to or exceeds the unit amount $Q_{10}$, a count value P is increased by one in the next process step S104, and then, the unit amount $Q_{10}$ is subtracted from the accumulated amount $\Sigma Q_3$ in the process step S105 to update the value $\Sigma Q_3$.

The count value P has been initialized to zero, and is incremented by one every time the process passes through the process step S104. Therefore, the count value P indicates how many times the accumulated amount $\Sigma Q_3$ reached the unit amount $Q_{10}$ in the time period $T_1$.

When the time period $T_1$ is expired, the process proceeds from the process step S101 to S102. If the count value P is not zero, the count value P is decremented by one in the process step S106 and no replenishment with the replenisher $q_1$ is performed. The sequence from the step S102 to S106 is repeated every time the process enters the "TASK-1" until the count value P returns to zero due to the repetition of the process step S106.

In other words, the replenishment with the replenisher $q_1$ is omitted P-times in the time point chain $t_1$, $t_2$, $t_3$ . . . (FIG. 3A) having a time pitch $T_1$. For example, if the accumulated amount $\Sigma Q_3$ in the time point $t_3$ is $1.3Q_{10}$ and the count value P is one, the supplementation at the time point $t_3$ with the replenisher $q_1$ is omitted as understood from the fact that a fat arrow with the symbol $Q_1$ is not indicated at the time point $t_3$. If the accumulated amount $\Sigma Q_3$ is $2.7Q_{10}$ and the count value P is two, the replenishment with the replenisher $q_1$ at $t=t_4$ is also omitted although this case is not illustrated in FIG. 3A.

In general, when the accumulated value $\Sigma Q_3$ is $\alpha Q_{10}$ where $\alpha$ is zero or a positive value, the number P of omittance is:

$$P=\text{trunc}(\alpha) \tag{1}$$

where the symbol "trunc" indicates truncation of a decimal part.

On the other hand, if P=0 in the process step S102, an amount $Q_1$ of the replenisher $q_1$ is calculated in the process step S107 through the equation:

$$Q_1=Q_{10}-\Sigma Q_3 \tag{2}$$

The value $Q_1$ is zero or positive since, if $\Sigma Q_3 > Q_{10}$, the accumulated value $\Sigma Q_3$ is decreased by repetition of the process step S105 until the value $\Sigma Q_3$ becomes equal to or less than $Q_{10}$. In the example where $\Sigma Q_3=1.3Q_{10}$, the value $\Sigma Q_3$ is decreased to $0.3Q_{10}$ by the process step S105, and the amount $Q_1$ is given by:

$$\begin{aligned} Q_1 &= Q_{10} - 0.3Q_{10} \\ &= 0.7Q_{10} \end{aligned} \tag{3}$$

Figure 7:
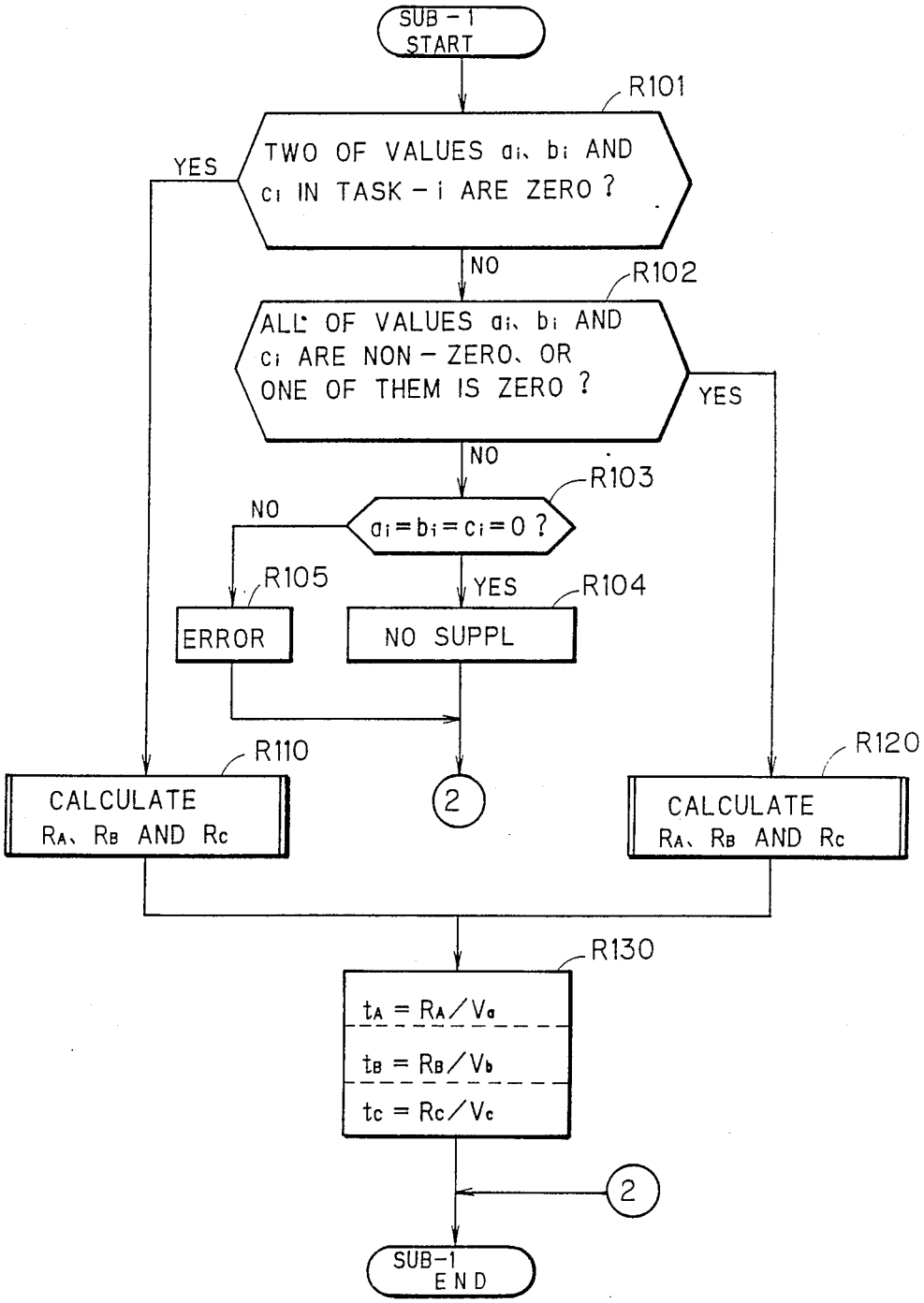
FIG. 7 is a flowchart showing a subroutine "SUB-1" for calculating activation times $t_A$, $t_B$ and $t_C$ of pumps, which is employed in "TASK-1" through "TASK-5"

After the value $Q_1$ is obtained, calculated in the next process step S108 are activation times $t_A$, $t_B$ and $t_C$ during which the pumps *9a*, *9b* and *9c* shall be activated or driven in order to deliver the chemicals A, B and C to the tank 2. The activation times $t_A$, $t_B$ and $t_C$ are determined so that the chemicals A, B and C are mixed at the ratio $a_1$:$b_1$:$c_1$ to give the amount $Q_1$ of the replenisher $q_1$, and a subroutine for determining the activation times $t_A$, $t_B$ and $t_C$ under various conditions is shown in FIG. 7 as "SUB-1", which will be described later.

Figure 9A:
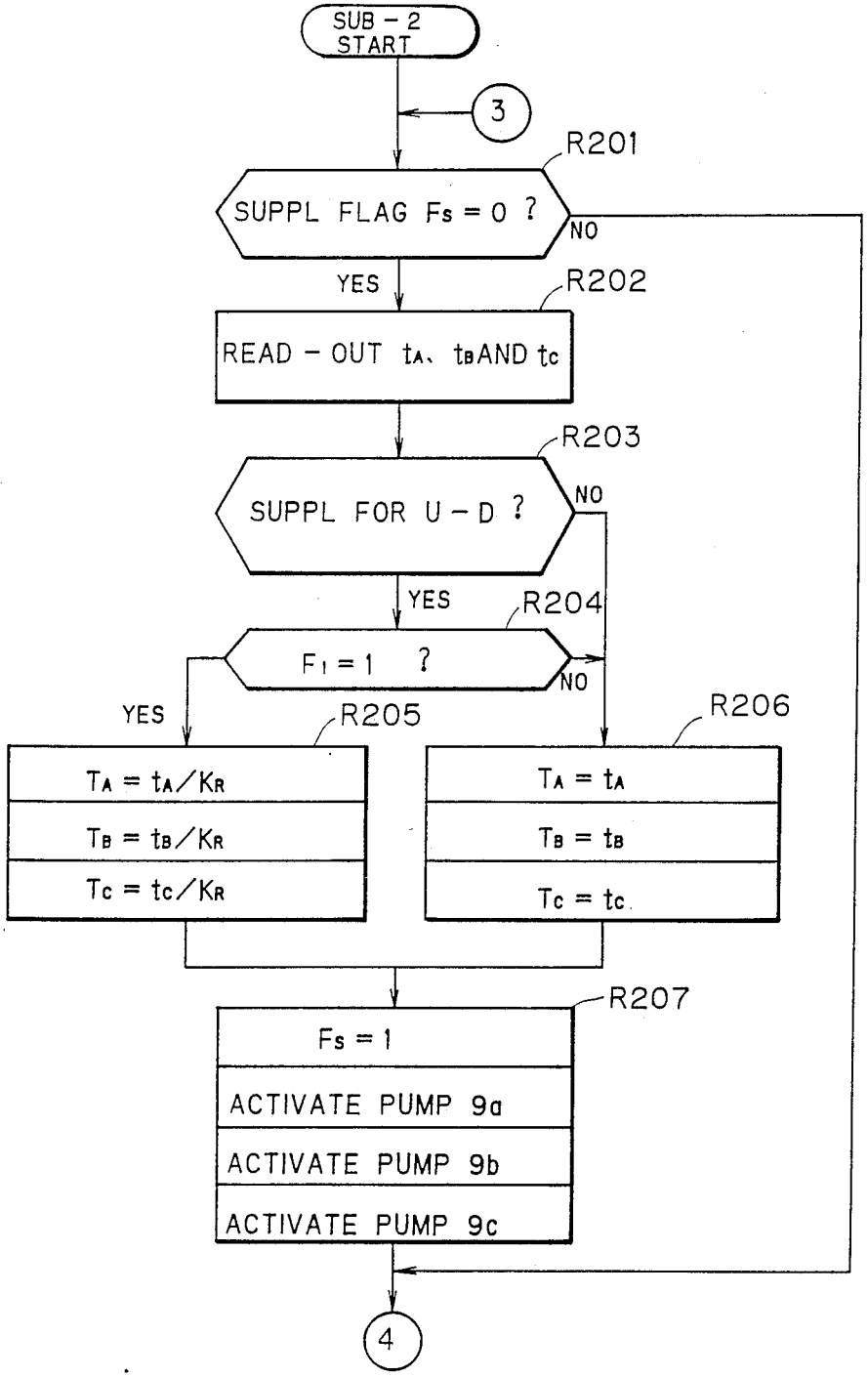
FIG. 9A and FIG. 9B show a subroutine "SUB-2" for activating and stopping the pumps, which is employed in "TASK-1" through "TASK-5"
Figure 9B:
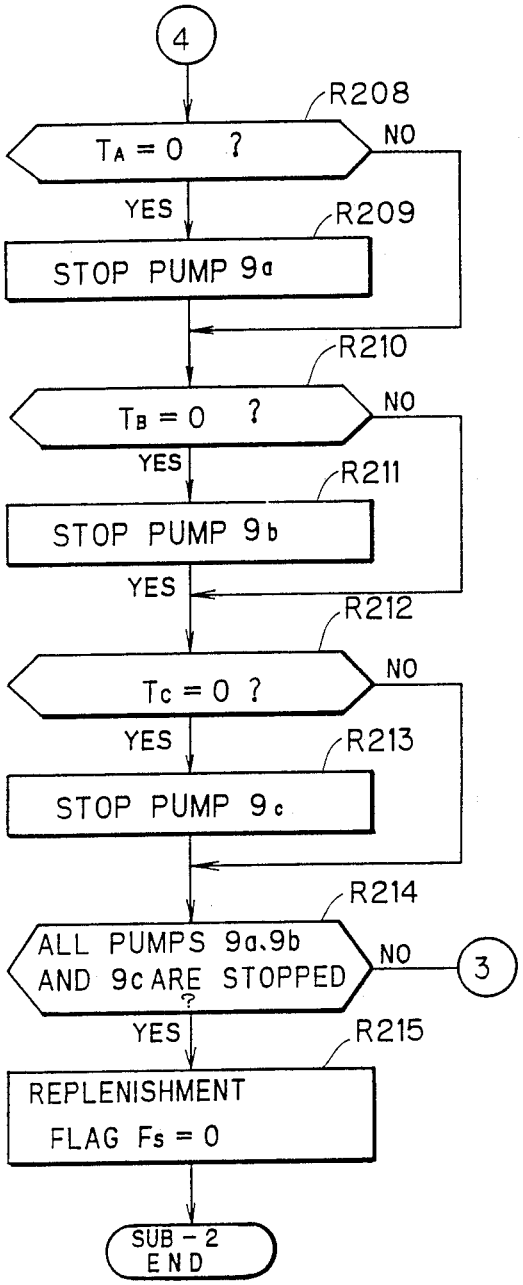

After the activation times $t_A$, $t_B$ and $t_C$ are calculated, the pumps *9a*, *9b* and *9c* are activated by the activation time periods $t_A$, $t_B$ and $t_C$ in the next process step S109 to supply the chemicals A, B and C to the tank 2, whereby the amount $Q_1$ of the replenisher $q_1$ as mixture of chemicals A, B and C at the mixing ratio $a_1$:$b_1$:$c_1$ is added to the developer in the tank 2. A subroutine for supplying the chemicals A, B and C to the tank 2 is shown in FIG. 9A and FIG. 9B as "SUB-2", which will be also described later.

After the process step S109 is completed, the value $Q_1$ is accumulated in the process step S110 in order to obtain the accumulated value $\Sigma Q_1$ which will be used later on. The accumulated value $\Sigma Q_1$ is stored in the storage region *12d* shown in FIG. 2. In the process step S110, values $R_A$, $R_B$ and $R_C$ representing respective amounts A, B and C which are supplied to the tank 2 are accumulated and stored in the storage region *12d*.

Therefore, in the case where $\Sigma Q_3=1.3\ Q_{10}$, the value $\Sigma Q_3$ is reduced to $\Sigma Q_3=0.3\ Q_{10}$ and the amount $Q_1=0.7Q_{10}$ of the replenisher $q_1$ according to the equation (3) is supplied to the tank 2 as shown at the time point $t_4$ in FIG. 3A. It is to be noted that the amount $Q_1$ is decreased by a part of the amount $\Sigma Q_3$ which has not been compensated by the full omittance of the replenishment with the replenisher $q_1$ at the time point $t_3$. In other words, the integer part of the coefficient $\alpha$ is directed to the full omittance of the replenishment with the replenisher $q_1$, and the decimal part of the coefficient $\alpha$ is directed to the partial omittance of the same.

(C-1) Determination of Activation Times $t_A$, $t_B$ and $t_C$

Referring to FIG. 7 where there is shown the subroutine SUB-1 for determining the activation times $t_A$, $t_B$ and $t_C$, first judged in the process step R101 is whether or not two of the values $a_i$, $b_i$ and $c_i$ in the "TASK-i" are zero. In the case that the subroutine SUB-1 is employed in the TASK-1 (the process step S108 in FIG. 6), the suffix in the subroutine SUB-1 is read as i=1.

Figure 8A:
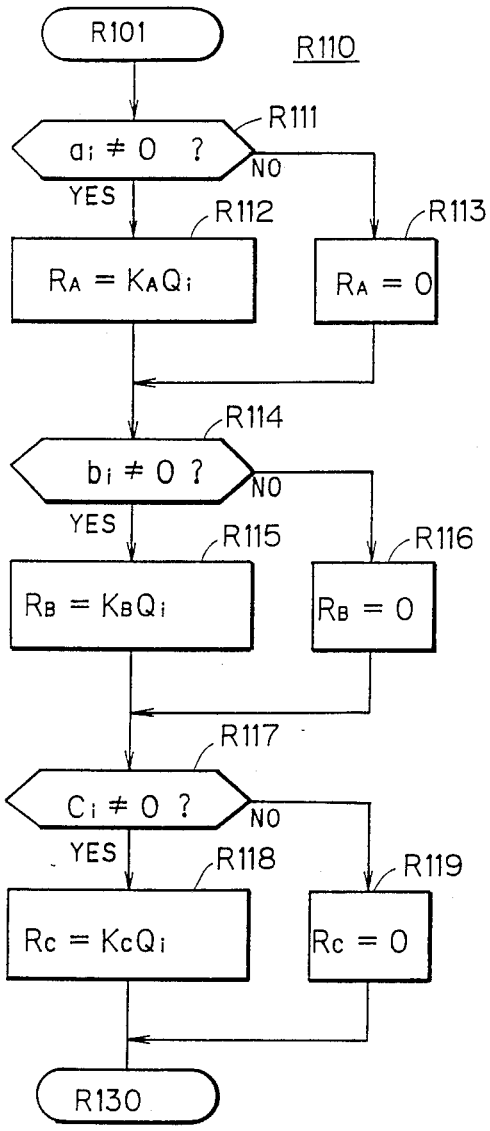
FIG. 8A and FIG. 8B show respective contents of the process steps R110 and R120 which are included in the subroutine "SUB-1"

When two of the values $a_i$, $b_i$ and $c_i$ representing the mixing ratio $a_i$:$b_i$:$c_i$ in the replenisher $q_i$ are zero, the process proceeds to the process step R110, details of which are shown in FIG. 8A. If the following conditions (4) and (5) are held, a coefficient $K_A$ of replenishment is defined through the expression (6), and respective delivery amounts $R_A$, $R_B$ and $R_C$ of the chemicals A, B and C are determined by the expressions (7) and (8), as understood from FIG. 8A.

$$a_1 \neq 0 \quad (4)$$
$$b_i = c_i = 0 \quad (5)$$
$$K_A = a_i \quad (6)$$
$$R_A = K_A Q_i \quad (7)$$
$$R_B = R_C = 0 \quad (8)$$

On the other hand, when the coefficient $b_i$ or $c_i$ is non-zero, an amount $R_B$ or $R_C$ is defined by the coefficient $b_i$ or $c_i$, and only the and $R_B$ or $R_C$ becomes non-zero, since the process steps R111–R113, R114–R116 and R117–R119 are symmetrical for the chemicals A, B and C.

If the condition indicated in the process step R101 in FIG. 7 is denied, it is further judged in the process step R102 whether or not one of the following conditions (9) and (10) is satisfied.

All of $a_i$, $b_i$ and $c_i$ are non-zero. (9)

One of $a_i$, $b_i$ and $c_i$ is zero. (10)

Figure 8B:
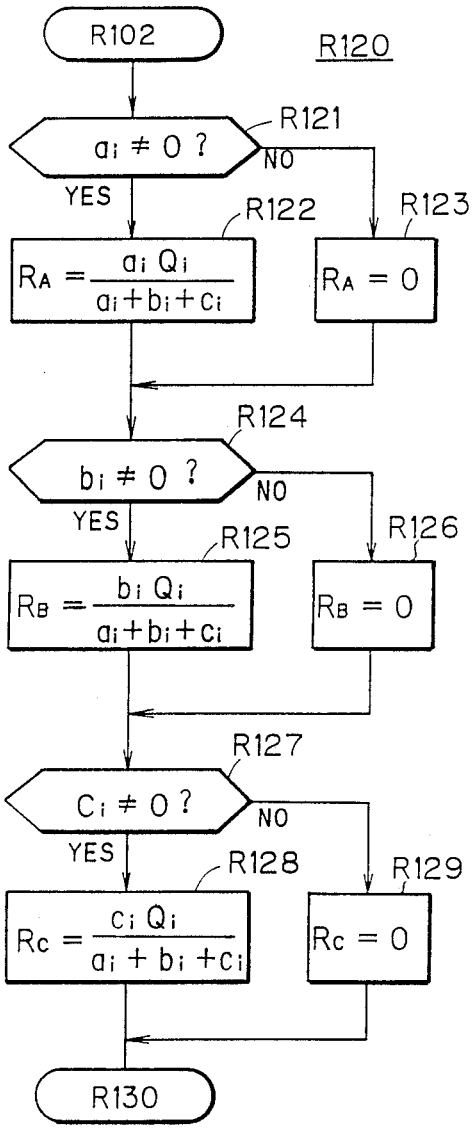

If satisfied, the process proceeds to the process step R120 in order to calculate the amounts $R_A$, $R_B$ and $R_C$ through the process steps R121–R129 (FIG. 8B). As is understood by comparing FIG. 8B with FIG. 8A, the amounts $R_A$, $R_B$ and $R_C$ under the condition (9) or (10) are determined so as to be proportional to the values $a_i$, $b_i$ and $c_i$, respectively.

If both of the conditions (9) and (10) are denied in the process step R102 (FIG. 7), it is further judged in the next process step R103 whether the following condition (11) is satisfied or not.

$$a_i = b_i = c_i = 0 \quad (11)$$

If satisfied, it is concluded that no replenishment with the replenisher $q_i$ is required and the process returns to the main task without replenishing the developer with the replenisher $q_i$. The fact that the replenisher $q_i$ is not supplied to the tank 2 is indicated on a display (not shown) which is provided in the operation panel 10. The indication in the process step R104 may be attained by displaying a comment informing the fact, or alternatively, by generating a flash signal on the display, for example.

On the other hand, if the condition (11) is denied in the process step R103, an error routine in the process step R103 is conducted and the process returns to the main task because the condition (11) must be satisfied if respective conditions in the process steps R101 and R102 are denied, as is easily understood by those skilled in the art.

After the amounts $R_A$, $R_B$ and $R_C$ are calculated in the process steps R110 or R120, the activation times $t_A$, $t_B$ and $t_C$ are calculated in the process step R130 through the following expressions (12)–(14):

$$t_A = R_A/V_a \quad (12)$$
$$t_B = R_B/V_b \quad (13)$$
$$t_C = R_C/V_C \quad (14)$$

where the amounts $V_a$, $V_b$ and $V_c$ are those of the chemicals A, B and C which are delivered by the pumps 9a, 9b and 9c per unit time, respectively. The values $t_A$, $t_B$ and $t_C$ are stored in the memory 12.

Then, the process returns to the process step S109 in the main task and the next subroutine "SUB-2" for driving the pumps 9a–9c is carried out as follows:

(C-2 Delivery of Chemicals

Referring to FIG. 9A where the subroutine "SUB-2" is depicted, it is judged in the process step R201 whether a replenishment flag $F_S$ is zero or not. As will be described later, the replenishment flag $F_S$ is set at one every time replenishment with the chemicals A, B and/or C is started, and is set at zero when the replenishment is completed. In other words, the replenishment flag $F_s$ indicates whether the replenishment is being conducted or not. In the initial state, the flag $F_S$ is set at zero, and therefore, the judgment in the first execution of the process step R201 results in "YES" and the process proceeds to the process step R202 for reading-out the values of the activation times $t_A$, $t_B$ and $t_C$ from the memory 12.

In the next process step R203, it is judged whether the replenishment now requested is the replenishment for compensating the used-deterioration of the developer.

Since the TASK-1 now employing the subroutine SUB-2 is that for compensating the running-deterioration, the process proceeds to the process step R206 and the values $t_A$, $t_B$ and $t_C$ are set in programmable counters (not shown) as initial counting values thereof. The programmable counters are down-counters provided in the controller 11, and the counting values $T_A$, $T_B$ and $T_C$ are decremented by one from their initial values $t_A$, $t_B$ and $t_C$ every time a clock pulse is supplied thereto, respectively. The contents of the process step R205 will be described later, and therefore, the description thereof is omitted here.

After the values $t_A$, $t_B$ and $t_C$ are set in the programmable counters, the replenishment flag $F_S$ is forced to one and the pumps 9a–9c are activated in response to the drive power generated by the pump driver 17 (the process step R207). Consequently, the chemicals A, B and C are sucked from the chemical tanks 7a–7c to be delivered to the developing tank 2 through the pumps 9a–9c and the pipe line network PL, whereby the chemicals A, B and C are mixed in the developing tank 2.

The following process steps R208–R213 (FIG. 9B) are directed to operation to monitor the counting values $T_A$, $T_B$ and $T_C$, and operation to stop the pumps 9a–9c. That is, when the counting value $T_A$ ($T_B$ or $T_C$) reaches zero as the clock time progresses, the corresponding pump 9a (9b or 9c) is stopped in response to a stop signal supplied from the controller 11 to the pump driver 17. Before all of the counting values $T_A$, $T_B$ and $T_C$ reach zero, the process sequence consisting of the process steps R208–R214 is repeated due to the return path from the process step R214 to R201. Since the replenishment flag $F_S$ was set at one in the process step R207 and no change is given thereto until the times $t_A$,$t_B$ and $t_C$ are over, the repetition cycle bypasses the process steps R202–R207.

When all of the counting values $T_A$, $T_B$ and $T_C$ reach zero and the pumps 9a–9c are stopped, the process goes out of the repetition cycle and the replenishment flag $F_S$ is forced into zero (the process step R215). Respective amounts $G_A$, $G_B$ and $G_C$ of the chemicals A, B and C which have been actually supplied to the developing tank 2 during the replenishment are estimated as:

$$G_A = t_A \cdot V_a = (R_A/V_a)V_a = R_A \quad (15)$$
$$G_B = t_B \cdot V_b = (R_B/V_b)V_b = R_B \quad (16)$$
$$G_C = t_C \cdot V_c = (R_C/V_c)V_c = R_C \quad (17)$$

and therefore, the calculated amounts $R_A$, $R_B$ and $R_C$ of the chemicals A, B and C are surely supplied to and mixed in the tank 2. In the case where the amounts $R_A$, $R_B$ and $R_C$ are calculated through the routine shown in FIG. 8B, for example, the ratio of the amounts $G_A$, $G_B$ and $G_C$ (or $R_A$, $R_B$ and $R_C$) is given by:

$$\begin{aligned} & G_A{:}G_B{:}G_C \\ = \; & R_A{:}R_B{:}R_C \\ = \; & a_iQ_i{:}b_iQ_i{:}c_iQ_i \\ = \; & a_i{:}b_i{:}c_i \end{aligned} \quad (18)$$

due to the conditions shown in the blocks of the process steps R122, R125 and R128 in FIG. 8B. Therefore, it is confirmed that the subroutine SUB-2 fits the replenishment with the chemicals at the designated ratio thereof.

In the subroutine SUB-2, it is to be noted that the next request for replenishment is not accepted until the current replenishment is completed. That is, it is inhibited to force the programmable counters to return to their initial values in response to the next request for replenishment before all of the activation times $t_A$, $t_B$ and $t_C$ are over, and the process steps R202–R207 for the next replenishment are carried out after the current replenishment is terminated and the replenishment flag $F_S$ is forced into the zero.

Figure 14A:
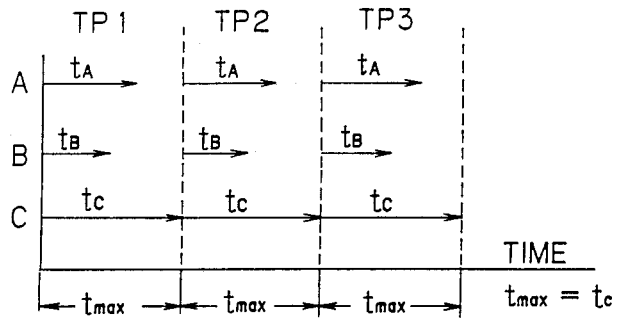
FIG. 14A through FIG. 14C are timing charts showing timing arrangements of respective start points in deliveries of chemicals A, B and C.

In order to clarify the condition, supposed is the case where $t_B < t_A < t_C$, and a maximum time $t_{max}$ within the activation times $t_a$, $t_b$ and $t_c$ is defined ($t_{max} = t_c$, in the example now considered). Consequently, as shown in FIG. 14 A, the delivery of the chemicals A, B and C for the first replenishment is performed in the time period TP1 as depicted by arrows in FIG. 14A, and the second replenishment responsive to the next request for replenishment is carried out in the next time period TP2 which follows TP1. Similarly, the third replenishment is performed in the third time period TP3. Each of the time periods TP1–TP3 has a time range of $t_{max}$.

Figure 15:
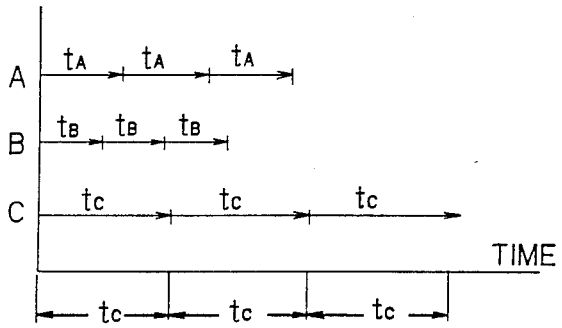
FIG. 15 is a timing chart which is to be compared with FIG. 14A through FIG. 14C in order to understand advantages of the timing arrangements.

Since none of the activation times $t_A$, $t_B$ and $t_C$ exceed the maximum time $t_{max}$, no overlap is caused between one delivery of each chemical A (B or C) and the following delivery thereof responsive to the next request of replenishment. Consequently, the respective replenishments responsive to successive requests are distributed in time, so that a constant ratio of the chemicals is substantially maintained in the developing tank 2 and respective photosensitive films can be treated in the tank 2 under an uniform chemical action. If the replenishment flag $F_S$ were not employed and successive requests for replenishment were accepted before the designated amounts of all chemicals A, B and C have not been supplied to the tank 2 in the previous replenishment, the replenishments with the chemicals A and B would be concentrated in time as shown in FIG. 15, so that a chemical balance in the tank 2 would be lost and uniform treatment of photosensitive films would not be attained. Therefore, the arrangement of replenishment in time which is employed in the present invention is quite effective for the uniform treatment of photosensitive films.

The arrangement of replenishments in time may be modified as follows:

(a) The time period for postponing acceptance of the next request for replenishment may be longer than the maximum time $t_{max}$, since the distribution of replenishment in time can be attained also with the modification.

Figure 14B:
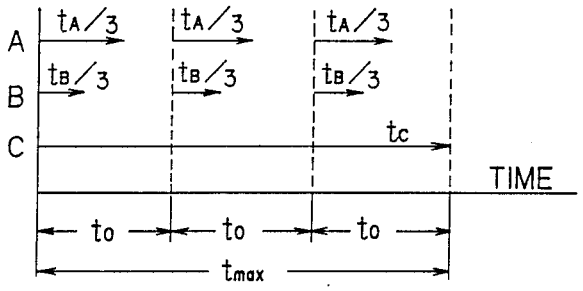

(b) Referring to FIG. 14B where the time scale is magnified as compared with FIG. 14A, the maximum time $t_{max}$ is divided into a plurality of terms $t_0$ and the delivery of the chemicals A and B for one request of replenishment is divided into a plurality of partial deliveries. If the division number is three, for example, the delivery of the chemicals A and B are divided into three sections and the chemicals A and B are supplied to the tank 2 by terms of $t_A/3$ and $t_B/3$ in each section, respectively.

Figure 14C:
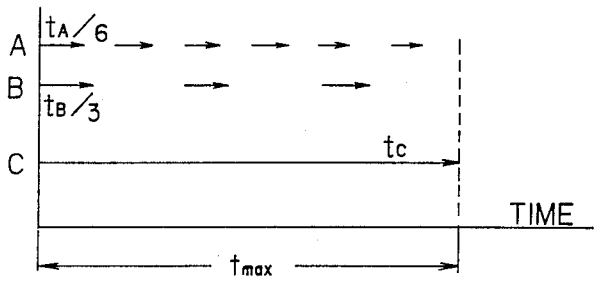

(c) Respective activation times $t_A$ and $t_B$ are divided into different numbers of sections, as shown in FIG. 14C. In the example illustrated in FIG. 14C, the activation time or delivery time $t_A$ of the chemical A is divided into six sections each having $t_a/6$, while the delivery time $t_b$ of the chemical B is divided into three sections each having $t_B/3$. As is understood from FIG. 14B and FIG. 14C, each of the activation times $t_A$ and $t_B$ is divided into a plurality of time sections so that the total of the time sections is the designated activation time $t_a$, $t_b$.

D. Compensation of Resting-Deterioration

Figure 10:
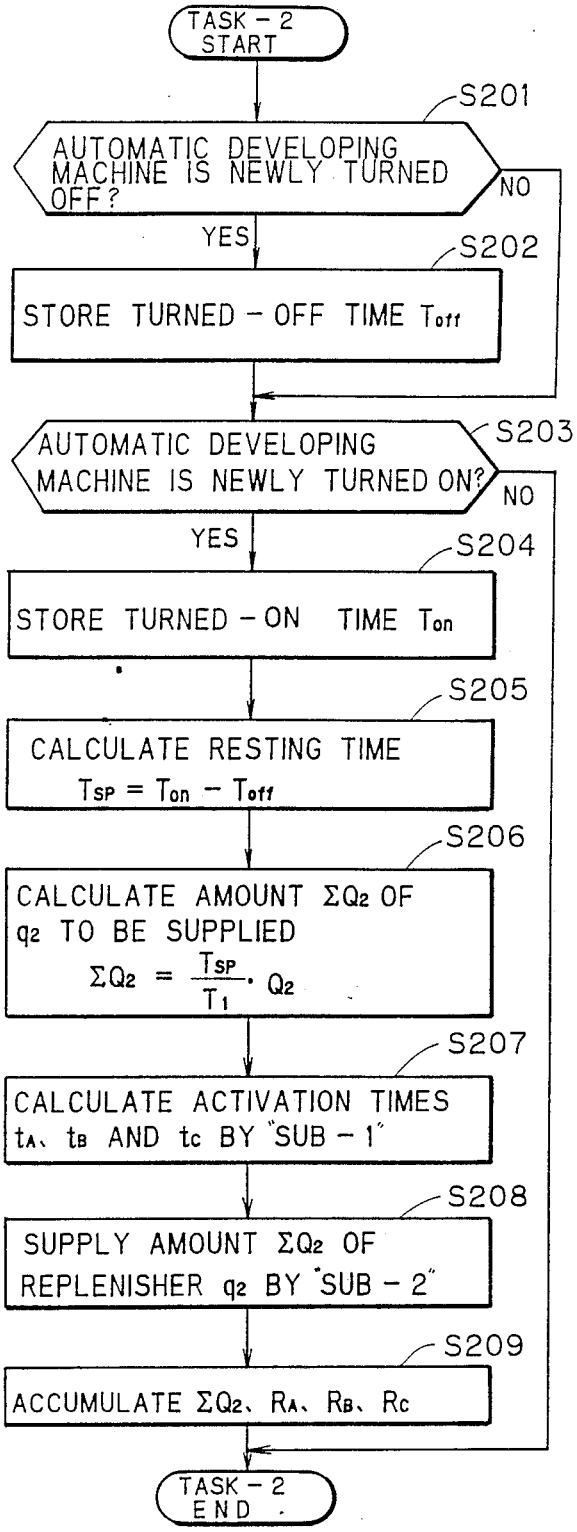
FIG. 10 is a flowchart showing "TASK-2" which corresponds to a program $P_2$ of replenishment for compensating a resting-deterioration.

FIG. 10 is a flowchart showing the TASK-2 or program $P_2$ for supplying the replenisher $q_2$ to the tank 2 in order to compensate the resting-deterioration of the developer. In the process step S201, it is judged whether the automatic processor 1 is turned off by the operator. If turned off, the turned-off time $T_{off}$ is detected by referring to the timer 14 and a data representing the turned-off time $T_{off}$ is stored in the memory 12, in the process step S202.

Before the automatic processor 1 is turned on for resuming the developing of photosensitive films, the judgment in the next process step S203 results in "NO", and the following process steps S204–S209 are bypassed. In the repetition of the TASK-2 which is attained by the repetition cycle in the main task of FIG. 4, respective results in the judgments of the process steps S201 and S203 are "NO" until the automatic processor 1 is turned on again, so that a substantial task is not performed.

When the automatic processor 1 is turned on again by the operator, the process proceeds to the process step S204, whereby the turn-on time $T_{on}$ is detected with reference to the timer 14 and is stored in the memory 12. Then the resting time $T_{sp}$ during which the automatic processor 1 has been stopped or rested is calculated by subtracting the turn-on time $T_{on}$ from the turn-off time $T_{off}$ (the process step S205).

The amount $\Sigma Q_2$ of the replenisher $q_2$ which is to be supplied to the tank 2 is calculated in the process step S206 through the equation:

$$\Sigma Q_2=(T_{sp}/T_1)Q_2 \quad (19)$$

The amount $\Sigma Q_2$ obtained through the equation (19) corresponds to the accumulated amount which is calculated by accumulating or summing the unit amount $Q_2$ every time the time period $T_1$ is expired during the automatic processor 1 is resting. The dotted arrows in the time section TS5 (FIG. 3B) represent imaginary replenishments with the unit amount $Q_2$ of the replenisher $q_2$ and the amount $\Sigma Q_2$ corresponds to the sum thereof.

Then, in the process step S207, the subroutine SUB-1 is called for, in order to calculate the activation times $t_A$, $t_B$ and $t_C$ under the condition where the value $Q_i$ in FIG. 8A and FIG. 8B is interpreted as $\Sigma Q_2$. The other subroutine SUB-2 is then called for and the chemicals A, B and C are delivered to the tank 2 to supply the amount $\Sigma Q_2$ of the replenisher $q_2$ to the tank 2 (the process step S208). The respective values expressing the amount $\Sigma Q_2$, $R_A$, $R_B$ and $R_C$ are accumulated in the storage region **12*d* (FIG. 2) in the process step S209**.

Therefore, through the TASK-2, the amount $\Sigma Q_2$ of the replenisher $q_2$ for compensating the resting-deterioration of the developer is supplied to the tank 2 just after the operation of the automatic processor 1 is resumed.

E. Compensation of Used-Deterioration

Figure 11:
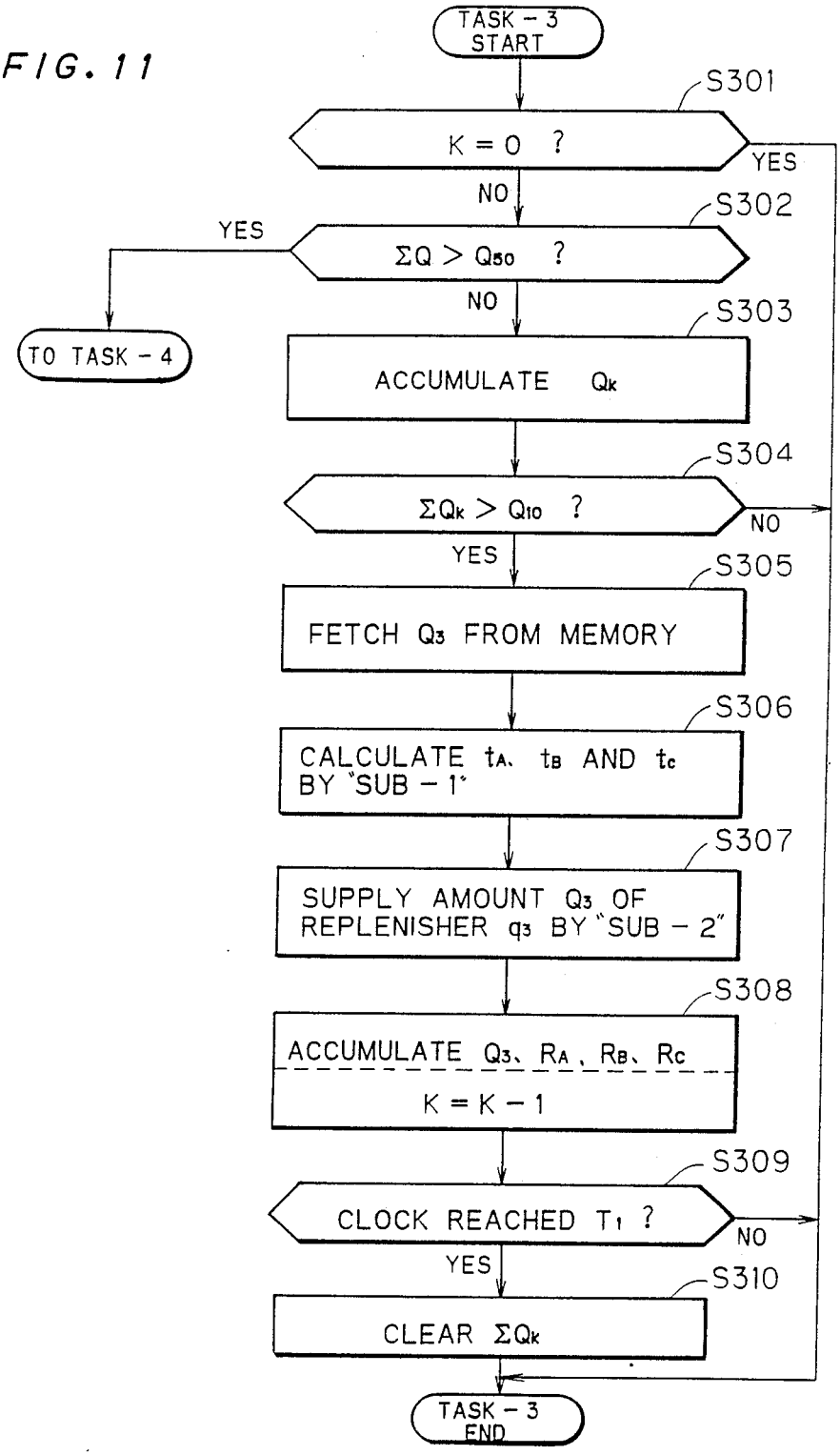
FIG. 11 is a flowchart showing "TASK-3" which corresponds to a program $P_3$ of replenishment for compensating a used-deterioration.

Referring to FIG. 11, there is shown a flowchart of the TASK-3 or program $P_3$ for compensating the used-deterioration of the developer with the replenisher $q_3$.

In the first process step S301, it is judged whether the counting value K is zero or not. Since the counting value K is incremented by one every time an unit area of photosensitive films is treated in the automatic processor 1, it is recognized that at least a unit area (480 inch$^2$, for example) of photosensitive films has been brought into the automatic processor 1 in the case where the value K is non-zero. Consequently, if the value K is not zero, it is further judged in the next process step S302 whether or not the total amount $\Sigma Q$ of replenishers having been supplied to the tank 2 from the start point of the time period $T_5$ to the current time exceeds the unit amount $Q_{50}$ which is previously designated, where the total amount $\Sigma Q$ is the sum of $\Sigma Q_1$, $\Sigma Q_2$ and $\Sigma Q_3$, and is calculated in the TASK-5 which will be described later. If the value $\Sigma Q$ exceeds the unit value $Q_{50}$, the process proceeds to "TASK-4", which will be described in the next section.

On the other hand, if does not exceed, the value $Q_k$ representing a predetermined imaginary amount of the replenisher $q_3$ is accumulated. The accumulation is schematically illustrated in FIG. 3A by dotted steps. Preferably, the value $Q_k$ is determined in accordance with an optimum amount of the replenisher $q_3$ which is to be supplied to the tank 2 for compensating the used-deterioration of the developer in the imaginary case where the replenisher $q_3$ is supplied to the tank 2 every time an unit area of photosensitive films is treated by the automatic processor 1, and the value $Q_k$ may be equal to the unit value $Q_3$. The accumulation of the value $Q_k$ is performed in the process step S303 and an accumulated value $\Sigma Q_k$ is stored in the memory 12.

If the current one of the accumulated value $Q_k$ does not exceed the predetermined unit amount $Q_{10}$, the replenishment with the replenisher $q_3$ is not carried out at this time and the TASK-3 is terminated. On the other hand, when exceeds, the process proceeds from the process step S304 to S305 to fetch the value of the predetermined amount $Q_3$ from the storage region **12*b*. Then, the activation times $t_A$, $t_B$ and $t_C$ are calculated by the subroutine SUB-1 (the process step S306**).

Although the subroutine SUB-2 is then performed in the next process step S307, the activation times $t_A$, $t_B$ and $t_C$ of the pumps **9*a*–9*c* are reduced if the area $\Sigma M$ of photosensitive films which has been treated in the previous time period $T_M$ exceeds the predetermined threshold value $M_0$. That is, when the flag $F_1$ is forced into one in the process step S10 (FIG. 4), the process in the subroutine SUB-2 (FIG. 9A) proceeds to the process step R205 through R203 and R204**.

In the process step R205, the activation times $t_A$, $t_B$ and $t_C$ are reduced by a predetermined factor $K_R$ to be set as initial values of the programmable counters provided for counting driving times of the pumps **9*a*–9*c*. The factor $K_R$ has a value larger than one, e.g., $K_R=2$, and therefore, the amount $Q_3$ of the replenisher $q_3$ which is actually supplied to the tank 2 is reduced as compared with the case where the process step R205** is not conducted. The reason for reducing the activation times is as follows:

If many of photosensitive films are brought into the automatic processor 1 over one time period $T_5$, the total amount of replenishers which are supplied to the tank 2 in the time period $T_5$ becomes large. Consequently, the chemical activity of the developer in the tank 2 sometimes becomes excessively high and the chemical balance in the developer is lost, so that uniform treatment of photosensitive films is hardly attained. In order to avoid the problem, the TASK-5 which will be described later is constructed so as to reduce the amount $Q_5$ of the replenisher $q_5$ which is supplied at the end point of the time period $T_5$ (see the time section TS7 in FIG. 3B), in proportion to the excess part of the total amount having been supplied.

However, if a large amount of photosensitive films are brought into the automatic processor 1 within a relatively short time period, the chemical activity of the developer in the tank 2 becomes excessively high in the short time period due to the delivery of the replenishers in proportion to the amount of photosensitive films. Such an excess is hardly compensated only with the reduction of the amount of the replenisher $q_5$, and it is preferred to reduce the supplied amount of the replenishers in early stages.

On the other hand, in the case where the excess of the supplied replenishers is detected in every short time period $T_M$ and the supplied amount $Q_3$ of the replenisher $q_3$ is reduced, the excess of the supplied replenishers can be compensated without waiting for the expiration of the long time period $T_5$. Therefore, the reduction of the amount $Q_3$ is effective for attaining the uniform treatment of photosensitive materials. The replenishment of the developer with the replenisher $q_3$ is illustrated by the steps above the horizontal line $Q=Q_{10}$ in FIG. 3A.

The reduction is directed only to the replenishment with the replenisher $q_3$ for the used-deterioration of the developer, and such a reduction of amount is not necessary for the replenishments for the running-deterioration and the resting-deterioration, since the replenishments of these types are not directed to concentration of photosensitive films.

The threshold value $M_0$ is determined on the basis of the total area of photosensitive films which are treated in the automatic processor 1 in each time period $T_M$ in the case where a standard number of photosensitive films are brought into the automatic processor 1 in each unit time. Preferably, the value $M_0$ is three times the total area corresponding to the above-indicated standard condition. Since the accumulated value $\Sigma Q_1+\Sigma Q_3$ in the time period $T_M$ reflects the total area of the treated photosensitive films in the period $T_M$, the value $\Sigma Q_1+\Sigma Q_3$ may be used in place of the value $\Sigma M$ for judging whether the reduction of the amounts $Q_3$ is required or not.

Then, the values $Q_3$, $R_A$, $R_B$ and $R_C$ are accumulated in the storage region **12*d* every time the amount $Q_3$ of the replenisher $q_3$ is supplied to the tank 2 in order to obtain the accumulated value $\Sigma Q_3$ therein (the process step S308), and the counting value K is decremented by one to indicate that the replenishment with the replenisher $q_3$ has been once performed. Although the amount $Q_3$ is reduced by the process step R205 (FIG. 9A), the accumulation is performed with respect to the amount $Q_3$ rather than the reduced amount $Q_3/K_R$. The accumulated value $\Sigma Q_k$ is cleared to zero when the clock reaches the end point of the current time period $T_1$ (the process step S310). This is because the replenishment of the replenisher $q_3$ is closed at the end point of the time period $T_1$ and is resumed by start of the next time period $T_1$. This is understood also from the illustration in FIG. 3A** where the dotted and solid steps fall to the line $Q=0$ every time a time period $T_1$ is expired.

F. Compensation of Concentrated-Deterioration

Figure 12:
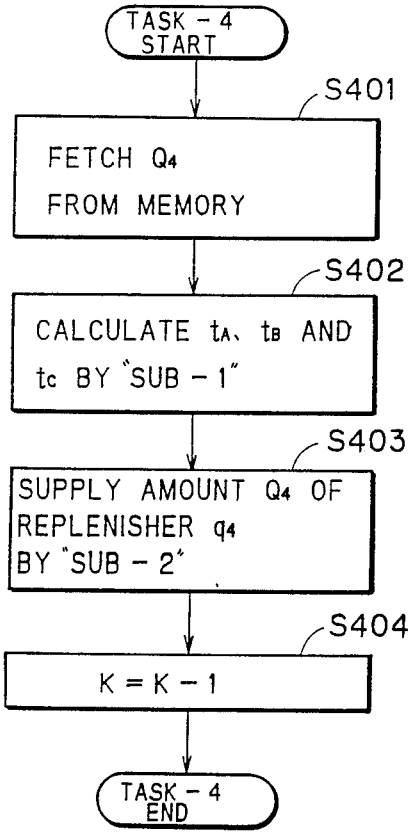
FIG. 12 is a flowchart showing a "TASK-4" or a program $P_4$ for compensating a concentrated-deterioration.

FIG. 12 is a flowchart showing the TASK-4 of program $P_4$ for supplying the replenisher $q_5$ in order to compensate the concentrated-deterioration of the developer. As is hereinabove described, the TASK-4 is conducted only when the total amount $\Sigma Q$ exceeds the unit amount $Q_{50}$ in the judgment in the process step S302 (FIG. 11).

Referring the FIG. 12, the value representing the unit amount $Q_4$ is fetched from the storage region **12*b* (the process step S401). The subroutines SUB-1 and SUB-2 are called for, and the amount $Q_4$ of the replenisher $q_4$ is supplied to the tank 2 (the process step S402 and S 403) in order to compensate the concentrated-deterioration which is caused when many of photosensitive materials are brought into the automatic processor 1** successively in one time period $T_1$.

As is understood from FIG. 4 (the process step S7) and the relationship between the routine in FIG. 11 and FIG. 12, the TASK-4 is performed in place of the TASK-3 when $\Sigma Q>Q_{50}$, in order to rapidly compensate the high deterioration of the developer having been caused by the concentration of photosensitive films. Accordingly, the TASK-4 is performed such that the amount $Q_4$ of the replenisher $q_4$ is repeatedly supplied to the tank 2 by K-times even if one time period $T_1$ is expired and the clock time progresses to the next time period $T_1$. This repetition over a plurality of time periods $T_1$ is illustrated in the time section TS6 of FIG. 3B where solid steps indicating the replenishment with the replenisher $q_4$ are depicted in both of two time periods $T_1$ neighboring each other on the time axis. The repetition by K-times is attained by the combination of the process step S404 (FIG. 12) and S301 (FIG. 11) under the repetition cycle in the main task (FIG. 4).

G. Compensation of Accumulated-Deterioration

Figure 13:
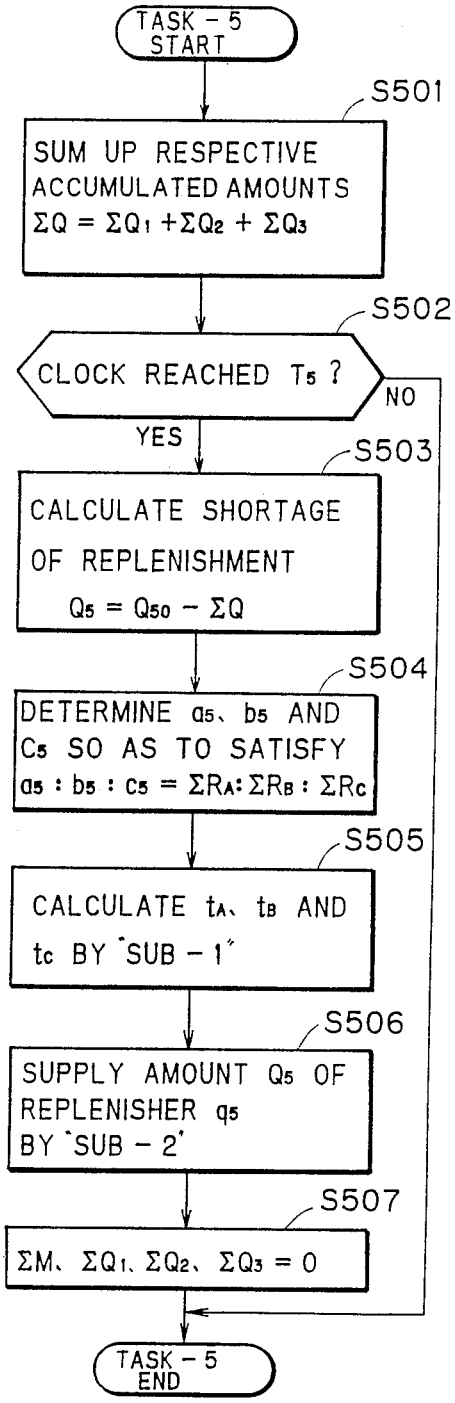
FIG. 13 is a flowchart showing "TASK-5" of a program $P_5$ for compensating an accumulated-deterioration.

The TASK-5 of the program $P_5$ which is directed to compensation of the accumulated-deterioration of the developer is shown in FIG. 13. In the process step S501, the substantial routine is effectuated and the respective accumulated values $\Sigma Q_1$, $\Sigma Q_2$, and $\Sigma Q_3$ are summed up to obtain the value representing the total amount $\Sigma Q$ of the replenishers which have been supplied to the tank 2 in the time period $T_5$ (the process step S501). The respective values of the amounts $\Sigma Q_1$, $\Sigma Q_2$ and $\Sigma Q_3$ can be found by referring to the storage region **12*d*. The value $\Sigma Q$ will be used in the following process step S503 and the process step S302 (FIG. 11**) in the next repetition cycle in the main task.

The value $\Sigma Q$ may be obtained by summing up the values $\Sigma R_A$, $\Sigma R_B$ and $\Sigma R_C$ representing respective total amounts of the chemicals A, B and C which have been supplied to the tank 2 in the time period $T_5$ rather then by summing up the values $\Sigma Q_1$, $\Sigma Q_2$ and $\Sigma Q_3$. This is because the accumulation of the values $R_A$, $R_B$ and $R_C$ is not performed in the TASK-4, and the accumulated values $\Sigma R_A$, $\Sigma R_B$ and $\Sigma R_C$ do not include the values $R_A$, $R_B$ and $R_C$ of the replenisher $q_4$, so that the sum:

$$\Sigma R_4+\Sigma R_B+\Sigma R_C \tag{20}$$

is equal to:

$$\Sigma Q=\Sigma Q_1+\Sigma Q_2+\Sigma Q_3 \tag{21}$$

Since the total value $\Sigma Q$ can be obtained also from the values $\Sigma R_A$, $\Sigma R_B$ and $\Sigma R_C$, the accumulation of the values $Q_1$, $Q_2$ and $Q_3$ in the storage region **12*d*** may be omitted.

On the other hand, the accumulated values $\Sigma R_A$, $\Sigma R_B$ and $\Sigma R_C$ may be obtained from the values $\Sigma Q_1$, $\Sigma Q_2$ and $\Sigma Q_3$ through the following equations (22)–(24):

$$\Sigma R_A = a_1\Sigma Q_1/(a_1 + b_1 + c_1) + a_2\Sigma Q_2/(a_2 + b_2 + c_2) + a_3\Sigma Q_3/(a_3 + b_3 + c_3) \tag{22}$$

$$\Sigma R_B = b_1\Sigma Q_1/(a_1 + b_1 + c_1) + b_2\Sigma Q_2/(a_2 + b_2 + c_2) + b_3\Sigma Q_3/(a_3 + b_3 + c_3) \tag{23}$$

$$\Sigma R_C = c_1\Sigma Q_1/(a_1 + b_1 + c_1) + c_2\Sigma Q_2/(a_2 + b_2 + c_2) + c_3\Sigma Q_3/(a_3 + b_3 + c_3) \tag{24}$$

Therefore, if the accumulated values $\Sigma Q_1$, $\Sigma Q_2$ and $\Sigma Q_3$ are stored in the storage region **12*d***, the accumulation of the values $R_A$, $R_B$ and $R_C$ may be omitted.

In the next process step S503, it is judged whether the clock time reached the end point of the period $T_5$. When reached, a shortage $Q_5$ of the total amount $\Sigma Q$ from the predetermined unit amount $Q_{50}$ is calculated through the equation (25).

$$Q_5=Q_{50}-\Sigma Q \tag{25}$$

The values $a_5$, $b_5$ and $c_5$ for designating the ratio of respective amounts of the chemicals A, B and C which are to be supplied to the tank 2 are then determined in the process step S504 so as to satisfy the following equation (26).

$$a_5:b_5:c_5=\Sigma R_A:\Sigma R_B:\Sigma R_C \tag{26}$$

The equation (26) has an ambiguity in determination of the values $a_5$, $b_5$ and $c_5$. That is, if a set of values $a_5$, $b_5$ and $c_5$ satisfying the equation (26) are found, another set of values $ka_5$, $kb_5$ and $kc_5$ (k=an arbitrary non-zero number) also satisfy the equation (26) and the latter set is another solution of the equation (26). However, the common factor k will be reducible at the numerator and the denominator in each of the equations in the process steps R122, R125 and R128 (FIG. 8B), the ambiguity in the factor k causes no problem.

On the other hand, there is no fractional function in which the factor k is reduced if the routine of FIG. 8A is conducted in place of that of FIG. 8B. However, since the values $R_A$, $R_B$ or $R_C$ are determined by the predetermined constant $K_A$, $K_B$ or $K_C$ in the routine of FIG. 8A rather than the values $a_5$, $b_5$ and $c_5$ themselves, the ambiguity in the factor k causes no problem also in the routine of FIG. 8A.

On the basis of the values $a_5$, $b_5$ and $c_5$ thus found, the activation times $t_A$, $t_B$ and $t_C$ are calculated and the amount $Q_5$ of the replenisher $q_5$ is supplied to the tank 2 (the process steps R505 and R506). Since the values $a_5$, $b_5$ and $c_6$ are determined through the equation (26), the amounts $G_A$, $G_B$ and $G_C$ of the chemicals A, B and C which are supplied to the tank 2 are:

$$G_A = \Sigma R_A Q_5/\Sigma R \quad (27)$$
$$G_B = \Sigma R_B Q_5/\Sigma R \quad (28)$$
$$G_C = \Sigma R_C Q_5/\Sigma R \quad (29)$$

where $$\Sigma R = \Sigma R_A + \Sigma R_B + \Sigma R_C \quad (30)$$

The advantages of the rule where the amounts $G_A$, $G_B$ and $G_C$ are determined so as to be proportional to the ratio $\Sigma R_A:\Sigma R_B:\Sigma R_C$ is as follows:

If the amounts $G_A$, $G_B$ and $G_C$ were determined so that the ratio $G_A:G_B:G_C$ is identical to a predetermined constant ratio, the chemical character of the supplied replenisher $q_5$ would be always constant regardless of the history of replenishments with the other replenishers $q_1$–$q_3$. Consequently, the chemical character of the supplied replenisher $q_5$ might be different from the optimum chemical character for compensating the accumulated-deterioration of the developer.

On the other hand, when the amounts $G_A$, $G_B$ and $G_C$ are determined according to the equations (27)–(29), the chemical character of the supplied replenisher $q_5$ coincides with the optimum one, since the ratio of the amounts $G_A$, $G_B$ and $G_C$ reflects the history of previous replenishments. For example, if the automatic processor 1 is stopped for a long time in the time period $T_5$, it is desirable that the chemical character of the replenisher $q_5$ is selected so as to be comparable with that of the replenisher $q_2$. According to the above-indicated improvement, the desirable chemical character is given to the replenisher $q_5$ through the equations (27)–(29) or the equation (26) as the base thereof because the accumulated values $\Sigma R_A$, $\Sigma R_B$ and $\Sigma R_C$ are mainly determined by the values $R_A$, $R_B$ and $R_C$ which are obtained in the replenishment with the replenisher $q_2$.

Incidentally, if the value of shortage $Q_5$ which is calculated by the equation (25) is negative or zero, the values $a_5$, $b_5$ and $c_5$ are forced to zero, and no replenishment is performed in the TASK-5.

After the process steps R505 and R506 are completed, the values $\Sigma M$, $\Sigma Q_1$, $\Sigma Q_2$ and $\Sigma Q_3$ in the storage region **12*d* are cleared to zero, whereby the contents in the storage region 12*d*** return to initial ones, i.e., all zero. When the clock time enters the the next time period $T_5$, the main task is repeated for replenishment control in the next time period $T_5$.

H. Advantages of Present Apparatus

The advantages of the present apparatus are summarized as follows:

(1) The present apparatus operates automatically while varying the ratio of supplied chemicals according to the type of the developer/fixer system, the purposes of replenishments and the running-conditions of the automatic processor 1. The mixing ratios of the supplied chemicals can be designated to desired values not only in the case that the number of the mixing ratios is two but also in the case that the same is three or more.

Consequently, the present apparatus can be used under various situations of replenishments, and the cost for manufacturing the apparatus is decreased as compared with an apparatus dedicated to replenishment at a certain ratio of chemicals because it is not necessary to prepare different sets of parts for various types of dedicated apparatuses.

(2) Since the supplied amounts of replenishers is monitored in every time period $T_M$ which is shorter than the time period $T_5$ and the amount of the replenishers in following replenishments is reduced before the time period $T_5$ is expired in the case that the supplied amount exceeds a predetermined amount, the excessive increase of the activity of the developer is substantially prevented.

Therefore, uniform development of photosensitive films for a long time is attained.

(3) As was described with reference to FIGS. 14A–14C and FIG. 15, the chemical balance of the developer is maintained by arranging or lining up respective starting points in supply of a plurality of chemicals even if requests for replenishments are caused successively. The uniform development of photosensitive films is attained also by the improvement.

(4) The ratio of the amounts of chemicals which are added to the developer at respective end points of the time period $T_5$ is varied according to the history of replenishments in the time period $T_5$. Accordingly, stable development of photosensitive films can be attained even if different types of developer/fixer system and different replenishment procedures of the replenishers are employed depending on the manufacturer thereof.

Therefore, the flexibility in use of the apparatus is increased and the stability in development is improved.

Although the present invention has been described and illustrated in detail, it is clearly understood that the same is by way of illustration and example only and is not to be taken by way of limitation. The spirit and scope of the present invention should be limited only by the terms of the appended claims.

We claim:

1. A method of replenishing a treatment liquid in an automatic processor with replenishers which are obtainable by mixing a plurality of chemicals, said treatment liquid being previously supplied to a treatment tank in which exposed photosensitive materials are treated by said treatment liquid for development of said photosensitive materials, said method comprising the steps of:

(a) determining a first time period, (b) dividing said first time period into two or more time periods to thereby define a series of second time periods, (c) delivering a first replenisher to said treatment tank wherein the delivery is controlled by a predetermined condition for replenishment in order to replenish said treatment liquid with said first replenisher, (d) calculating a developed area of photosensitive materials which are treated by said treatment liquid in said treatment tank within each second time period, (e) comparing said developed area with a predetermined threshold area, (f) reducing an amount of said first replenisher which is delivered to said treatment tank within a next time period when said developed area exceeds said threshold area, (g) calculating a total amount of said first replenisher which is delivered to said treatment tank within said first time period, (h) calculating the difference between a predetermined threshold amount and said total amount, and (i) delivering a second replenisher to said treatment tank when said first time period is expired in order to replenish said treatment liquid with said second replenisher, wherein an amount of said second replenisher delivered to said treatment tank is determined in accordance with said difference.

2. A method of claim 1 wherein said condition for replenishment includes a restriction that a designated amount of said first replenisher is delivered to said treatment tank for each unit developed area of photosensitive materials, and the step (f) includes the step of:

(f-1) reducing said designated amount by a predetermined factor larger than one.

3. A method of claim 2 wherein said condition for replenishment includes a restriction that said designated amount of said first replenisher is delivered to said treatment tank only after a first value is equal to a predetermined third value, wherein said first value is equal to a predetermined second value which increases every time a unit area of photosensitive materials is developed in said automatic processor within a third time period, said third time period being shorter than each said second time period, and the step (f-1) includes the step of:

(f-11) reducing said designated amount by said factor in order to reduce an amount of said first replenisher which is delivered to said treatment tank in proportion to an excess of said first value from said third value.

4. A method of replenishing a treatment liquid in an automatic processor with replenishers which are obtained by mixing a plurality of chemicals, said treatment liquid being previously supplied to a treatment tank in which exposed photosensitive materials are treated by said treatment liquid for development of said photosensitive materials, said method comprising the steps of:

(a) delivering a plurality of first replenishers to said treatment tank at different timings in order to replenish said treatment liquid with said plurality of first replenishers, respectively, wherein respective mixing ratios of said plurality of chemicals for producing said plurality of first replenishers are previously determined, (b) calculating respective total amounts of said plurality of chemicals which are used for replenishment of said treatment liquid in the step (a) within a predetermined time period, and (c) delivering a second replenisher to said treatment tank in order to replenish said treatment liquid with said second replenisher after said time period is expired, wherein said second replenisher is a mixture of said plurality of chemicals at a ratio proportional to a ratio of said total amounts.

5. A method of claim 4 wherein the step (c) includes the steps of:

(c-1) calculating a total amount of said plurality of first replenishers which are delivered to said treatment tank within said time period, and (c-2) calculating a difference between a predetermined amount and said total amount, an amount of said second replenisher delivered to said treatment tank being determined in accordance with said difference.

6. A method of claim 5 wherein the step (b) includes the steps of:

(b-1) accumulating in a computer memory respective amounts of said plurality of chemicals used in the step (a) every time each of said plurality of first replenishers is delivered to said treatment tank to thereby calculate said respective total amounts.

7. A method of claim 5 wherein the step (c-1) includes the steps of:

(c-11) summing up said respective total amounts of said plurality of chemicals to obtain said total amount of said plurality of first replenishers.

8. A method of claim 4 wherein respective mixing ratios of said plurality of chemicals for producing said plurality of first replenishers are partially or fully different from each other.

* * * * *